US005369381A

United States Patent [19]

Gamand

[11] Patent Number: 5,369,381

[45] Date of Patent: Nov. 29, 1994

[54] SLOW-WAVE TRANSMISSION LINE OF THE MICROSTRIP TYPE AND CIRCUIT INCLUDING SUCH A LINE

[75] Inventor: Patrice Gamand, Yerres, France

[73] Assignee: U.S. Philips Corporation, New York, N.Y.

[21] Appl. No.: 820,906

[22] PCT Filed: May 27, 1991

[86] PCT No.: PCT/NL91/00085

§ 371 Date: Jan. 17, 1992

§ 102(e) Date: Jan. 17, 1992

[87] PCT Pub. No.: WO91/19329

PCT Pub. Date: Dec. 12, 1991

[30] Foreign Application Priority Data

| | | | |
|---|---|---|---|
| May 29, 1990 | [FR] | France | 90 06626 |
| Jul. 6, 1990 | [FR] | France | 90 08598 |
| Mar. 8, 1991 | [FR] | France | 91 02813 |

[51] Int. Cl.[5] ..... H01P 1/18; H01P 3/08

[52] U.S. Cl. ..... 333/161; 333/116; 333/238

[58] Field of Search ..... 333/156, 161, 238, 246, 333/109, 110, 115, 116, 246, 128, 138, 140

[56] References Cited

U.S. PATENT DOCUMENTS

| | | | |
|---|---|---|---|
| 3,004,229 | 10/1961 | Stearns | 333/238 |
| 4,229,717 | 10/1980 | Krone et al. | 333/156 |
| 4,604,591 | 8/1986 | Vasile | 333/161 X |

FOREIGN PATENT DOCUMENTS

| | | |
|---|---|---|
| 2818854 | 10/1979 | Germany . |
| 2042812 | 9/1980 | United Kingdom . |
| 2056783 | 3/1981 | United Kingdom . |

OTHER PUBLICATIONS

Farber, "Propagating Signals Across Semiconductor Wafers", IBM Tech. Disclosure Bulletin, vol. 8, No. 6, Nov. 1965, pp. 924–925.

Jäger, "Nonlinear Slow-Wave Propagation on Periodic Schottky Coplanar Lines", IEEE 1985 Microwave & Millimeter-Wave Monolithic Circuits Symposium-digest, Jun. 3–5 1985, pp. 15–17.

Gammand et al., "Slow Wave Propagation . . . IC Technologies", Electronics Letters, vol. 26, No. 18, Aug. 30, 1990, pp. 1443–1445.

Patent Abstracts of Japan, JP-A-57 197934, vol. 7, No. 49, E-161, Feb. 25, 1983.

*Primary Examiner*—Seungsook Ham

*Attorney, Agent, or Firm*—Paul R. Miller

[57] ABSTRACT

A wave transmission line, in the slow-wave mode, is of the microstrip type, including a first conductive layer (11) called lower layer which forms the ground plane, a second conductive layer (12) called upper layer in the form of a strip having specific transverse and longitudinal dimensions, and a third material (1,2) which is not conductive and is disposed between these two conductive layers. This transmission line has, in longitudinal direction, a periodic structure while each period L in length is formed of a bridge (4) followed by a column (13). Each bridge is constituted by an upper conductive strip section (12), having a length of $L_1 < L$, disposed on the surface of one such first part (1) of the third material, which has a dielectric nature. In addition, each column (13) is a capacitor which may be an active or a passive element. The first conductive layer (11) may further have recesses (5) underneath each bridge. A directional coupler (50) may be realised by means of such slow-wave lines and used for realising an integrated single-aerial transceiver arrangement.

39 Claims, 18 Drawing Sheets

SLOW-WAVE TRANSMISSION LINE OF THE MICROSTRIP TYPE AND CIRCUIT INCLUDING SUCH A LINE

The invention relates to a slow-wave transmission line of the microstrip type, comprising a first conductive layer called lower layer used as a ground plane, a second conductive layer called upper layer in the form of strips having specific widths and lengths and a third non-conductive material arranged between these two conductive layers.

The invention likewise relates to couplers formed by such lines.

The invention also relates to the circuits including such a line.

In addition to these circuits the invention relates to a transceiver arrangement including an integrated circuit which comprises a frequency duplexer for transmitting a first and receiving a second signal on a single pole.

The invention finds its application particularly in the realisation of integrable transmission lines, that is to say, lines which may be included in integrated circuits and, more specifically, in monolithic and microwave frequency integrated circuits known under the name of MMIC.

Generally, the invention finds its application in the miniaturisation of transmission lines and permits augmenting the integration density of the integrated circuits comprising these lines, and/or augmenting the operating performance of these circuits.

In the case where the integrated circuit comprising the frequency duplexer is used, the invention finds its application in single-antenna transmission and reception in the microwave frequency domain, an integrated duplexer isolating the transmitted signals from the signals transmitted by this single antenna.

BACKGROUND OF THE INVENTION

A transmission line of the microstrip type is described in the publication entitled: "Properties of Microstrip Line on Si-$SiO_2$ System" by HIDEKI HAZEGAWA et al. in "IEEE Transactions on Microwave Theory and Techniques, Vol. MMT-19, No. 11, November 1971, pp. 869–881".

According to the above document a microstrip line consists of a piled structure formed by a metallic layer used as a ground plane, a silicon (Si) semiconductor layer, a thin silicon dioxide ($SiO_2$) dielectric layer and a metallic strip having a given transverse dimension.

This document describes that such a line permits propagation in three fundamental modes. The first mode is a "quasi-TEM mode", the second is a "skin-effect mode" and the third is a "slow-wave mode".

The larger the resistivity of the semiconductor layer the more the propagation mode approaches a conventional TEM mode.

The third mode termed "slow-wave mode" appears when the operating frequency is low, of the order of 10 to $10^3$ MHz, and when the resistivity of the semiconductor layer is also low, of the order of $10^4$ or $10^2$ Ω.cm. In this "slow-wave mode" the magnetic energy is distributed over the semiconductor layer whereas the electric energy is stored in the dielectric layer. The sum of these energies is transmitted perpendicularly to the layers through the thin silicon dioxide ($SiO_2$) dielectric layer. The phase velocity thus diminishes due to the energy transfer to the interface of the semiconductor and the dielectric ($Si/SiO_2$).

The phase constant is expressed in terms of normalized wavelengths: $\lambda_g/\lambda_o$, which ratio is equal to the propagation velocity in the line divided by the velocity of light in free space. The maximum usable frequency largely depends on the resistivity of the semiconductor layer and becomes highest when the resistivity reaches $10^{-1}$ Ω.cm, while this frequency remains below the GHz domain.

Alternatively, the phase constant and the characteristic impedance of the line also very much depend on the transverse dimension of the strip and the thickness of the semiconductor layers and the dielectric separating the ground plane from the strip.

In conclusion, this document describes that the operation in the slow-wave mode presents high losses which could be diminished by devising a multi-layer structure between the ground plane and the strip, this multi-layer structure being formed by an alternation of semiconductor layers and thin dielectric layers so as to reduce the losses caused by the skin effect. If such a multi-layer structure were used for realising a microstrip line operating in the slow-wave mode, then the dimension of the line could be reduced which would permit reducing the dimensions of the integrated circuits with the line functioning in the GHz frequency domain or lower frequency domains.

A technical problem which is currently posed is the monolithic integration of the microwave circuits on a semi-insulating substrate. In effect, if a microwave circuit is not integrated monolithically, it performs less well because of losses in the inter-substrate connections, it functions at less high frequencies owing to parasitic capacitances that appear, it has a larger consumption, and it is more expensive because it requires larger semi-insulating substrate surfaces and more manufacturing stages.

The prior-art transmission lines necessary for realising microwave circuits, for example, the microstrip lines operating in the quasi-TEM mode have to date covered a considerable surface of the substrates and made monolithic integration difficult because the circuits have become complex.

The technical problem of monolithically integrating Microwave Integrated Circuits (MIC's) cannot be solved until the problem of miniaturisation of the transmission lines is solved, while considering the fact that it must be possible to fit in the miniaturisation with the manufacture of the other elements of the circuit, for example, transistors and interconnecting lines, and the fact that the losses in the lines are not to augment and that the operating frequency is to be that of the microwave circuits.

The prior-art arrangement does not meet these requirements. In effect, either it operates in the quasi-TEM mode and in this case the dimensions of the lines are too large, or it operates in the slow-wave mode with the advantage of a considerable phase shift and smaller dimensions, but in that case there are the following disadvantages:

the frequency domain investigated is too low and not compatible with the MMIC's;

the substrate presents too low a resistivity which is not compatible with the realisation of other elements of the MMIC's, or which at least bounds their performance;

the generation of the slow waves depends very much on the resistivity of the substrate, which entails that the doping of the substrate has to be considerably optimized. This optimization adds to the manufacturing costs of a circuit including such a line, whereas there is nevertheless a risk of dispersion when the circuit is in operation;

the arrangement formed by the line makes a ground plane necessary at the back of the substrate, which leads to technological problems with regard to realisation of the interconnections;

the operation losses in the slow-wave mode with a single semiconductor layer are very high; and if one wishes to diminish the losses in order, to benefit from the advantage presented by the slow-wave lines because their dimension is diminished, the manufacturing technique of the substrate that includes alternate semiconductor and dielectric layers renders the arrangement harder to realise, more costly, and less compatible with monolithic integration.

Thus, from the information the in the above article it appears that the lines operating in the slow-wave mode are eligible for realising monolithic integrated circuits because their dimensions could be minimized relative to those lines operating in the TEM mode or the conventional quasi-TEM mode, but, on the other hand, that their operating domain, their performance, and manufacturing technology is incompatible with that required for the MMIC circuits.

It is an object of the present invention to propose a slow-wave transmission line of the MICROSTRIP type in which the propagation structure is fully compatible with the integrated circuits, for example, with microwave integrated circuits and, more specifically, with MMIC's.

For this purpose it is an object of the invention to propose a slow-wave transmission line of the MICROSTRIP type whose characteristic features are independent of the characteristic features of the substrate.

It is an object of the invention to propose such a line without a ground plane on the back surface of the substrate.

It is an object of the invention to propose such a line of which the losses are not higher than those of the microstrip lines operating in the TEM mode or conventional quasi-TEM mode.

It is an object of the invention to propose such a line whose dimensions are several times smaller than those of the lines operating in the conventional TEM mode or quasi-TEM mode for identical characteristic features of the line.

It is an object of the invention to propose such a line capable of being connected to microwave circuits.

It is an object of the invention to propose such a line whose manufacturing process can be fully combined with the manufacturing processes of any conventional integrated circuit no matter what the selected semiconductor substrate selected for this circuit is, without increasing the number of steps necessary for the processes, using only layers or materials used in such processes.

SUMMARY OF THE INVENTION

According to the invention problems are solved by means of a circuit providing a slow-wave transmission line of the microstrip type, comprising a first conductive layer, called a lower first layer used a ground plate, a second conductive layer, called an upper layer in the form of strips having specific transverse and longitudinal dimensions, and a third non-conductive material disposed between the first and second conductive layers, characterized in that the transmission line has, in a longitudinal direction, a periodic structure, where each period having length $\lambda$ is formed by a bridge followed by one column, in that each bridge consists of an upper conductive strip section having a length $\lambda_1 < \lambda$ disposed on the surface of a first part of the third material which has a dielectric nature, and in that each column forms a capacitance.

The line according to the invention may thus be incorporated in a MMIC circuit presenting all the resulting advantages described hereinbefore.

It is a further object of the invention to provide a slow-wave transmission line whose operation is based on such a periodic structure, whose dimensions are smaller, and whose performance has also improved, by simply changing the design at the designing step of the integrated circuit masks.

This object is achieved by means of the above line, furthermore characterized in that the first conductive layer, used as the ground plane has at least one recess underneath each bridge.

This line has the property of presenting a higher delay than the previous line at the same frequency. This property also permits realising even shorter lines which are thus simpler to integrate for the same application. Considering the problems linked with the integration of microwave lines, this result forms an industrial advantage of the first order, without creating great additional technological problems.

On the other hand, since the transmission line obtained is shorter, the losses are diminished compared to the losses occurring in the prior-art line.

It is another object of the invention to provide a coupler of the type called a de Lange coupler which may easily be integrated, and which can be manufactured together with current microwave integrated circuits, and whose performance is also improved relative to that which may be expected from prior-art arrangements.

A de Lange coupler is known to those skilled in the art from the publication of "Interdigitated Stripline Quadrature Hybrid", IEEE, MTT, December 1969, pp. 1150–1151.

This prior coupler is realised in microstrip technology, that is to say, by means of microstrip conductors disposed on a first surface of a substrate having a given thickness, whose second surface accommodates the ground plane. Thus, given this manufacturing process, such a coupler is not fully compatible with current integrated circuit technology.

This prior-art coupler is constituted by an odd number, that is to say, at least 3, parallel transmission lines connected in alternate pairs for forming an interdigitated structure. The center line is called the main line and the coupler is fully symmetrical relative to the middle of the center line. Specifically its inputs and outputs are symmetrical.

The length L of the main line defines the operating frequency band of this coupler. This length L is of the order of a quarter of the wavelength $\lambda$ of the transmitted signal.

The operation of the de Lange coupler is based on the following principle: a coupling is provided between the parallel lines by means of an electromagnetic field. This coupling is of the capacitive or inductive type depending on the ratios between the length L of the main line and the wavelength $\lambda$ of the signals which are propagated in the coupler.

If $\lambda/4<L$ the coupling is capacitive, if $\lambda/4=L$ the coupling is both capacitive and inductive, if $\lambda/4>L$ the coupling is inductive.

On the other hand, there is a phase shift $\Delta\phi$ between the signals leaving the two outputs. This phase shift $\Delta\phi$ is equivalent to 90° in a frequency band cantered on the band where $\lambda=4L$.

Since the operating wavelength is linked with the dimensions of the coupler it seemed a priori impossible to change these dimensions for a given wavelength and in a selected technology.

As observed hereinbefore, the integrated circuit concept poses the problem of the ever larger reduction of the dimensions of the components for obtaining a greater integration density.

Therefore, it is one of the objects of the invention to provide a de Lange coupler of compact design whose dimensions are minimized relative to those of the prior art arrangements.

Furthermore, an integrated duplexer, or active duplexer, is known from the publication entitled: "DISTRIBUTED AMPLIFIERS AS DUPLEXER/LOW CROSSTALK BIDIRECTIONAL ELEMENT IN S BAND" by O. P. LEISTEN; R. J. COLLIER and R. N. BATES in "Electronics Letters, Mar. 3, 1988, Vol. 24, No. 5, pp. 264–265".

It should first be recollected that the technical problem posed to the expert who desires to use only a single aerial for transmitting and receiving two signals having different frequencies, with different amplitudes, is to realise a signal separator, also called a duplexer, which permits avoidance of crosstalk, that is to say, the intermodulation of transmitted and received signals.

Another technical problem posed to the expert is to realise such a duplexer in integrated form. The solution to this problem makes it possible to diminish the manufacturing costs, which is a considerable advantage especially in the domain of the products for the public at large, such as in the television domain or in automotive electronics, for example.

The above document states that the problem of separating transmitted and received signals may be solved by an active duplexer constituted by an integrable transmission-line amplifier operating in the microwave frequency domain.

The transmission-line amplifier described in above publication, however, presents several disadvantages:

it is integrable, it is true, but covers a considerable surface area; and although this surface area can be diminished when the circuit is devised for operating in the microwave frequency domain (60 GHz), it is considered at any rate too large by designers of the integrated circuits;

such a circuit is difficult to realise;

the crosstalk owing to this circuit is still too large; more specifically, it is much larger than that of the unintegrable hybrid circulators; in effect, the crosstalk is due to non-linearity of the active elements in the circuit described in above document; and such a circuit is noisy.

These problems are solved according to the present invention by means of a transceiver arrangement including an integrated circuit which comprises a frequency duplexer for transmitting a first signal and receiving a second signal on a single pole, characterized in that the integrated frequency duplexer is a directional coupler of the type mentioned above, having two such first poles connected by means of electromagnetic coupling to the second poles, in that one of the first poles constitutes an input for the first signal coming from a first amplifier, and the other first pole constitutes an output for the second signal which is propagated to the input of a second amplifier, and in that one of the second poles constitutes an output for the first signal and an input for the second signal and the other one of the second poles is isolated.

The transceiver arrangement according to the invention thus presents the following advantages:

the frequency duplexer, necessary for its operation is integrable, covers a smaller area than that of the prior-art distributed amplifier;

the crosstalk is virtually nothing; and noise is minimized.

BRIEF DESCRIPTION OF THE DRAWING FIGURES

The invention will be described in detail with respect to the annexed drawing Figures, in which:

FIG. 1*a* represents a top plan view of a microstrip slow-wave transmission line in a first embodiment;

FIG. 1*b* represents such a transmission line in a second embodiment;

FIG. 1*c* represents such a transmission line in a fifth embodiment;

FIG. 1*d* represents a top plan view of such a transmission line in a sixth embodiment;

FIG. 2*a* represents a cross-section of the line shown in FIG. 1*a* along the axis A—A' of FIG. 1*a;*

FIG. 2*b* represents a longitudinal section of the line of FIG. 1*a* along the axis B—B' of FIG. 1*a;*

FIG. 2*c* represents a cross-section of the line of FIG. 1*a* along the axis C—C' of FIG. 1*a;*

Figure 14A:
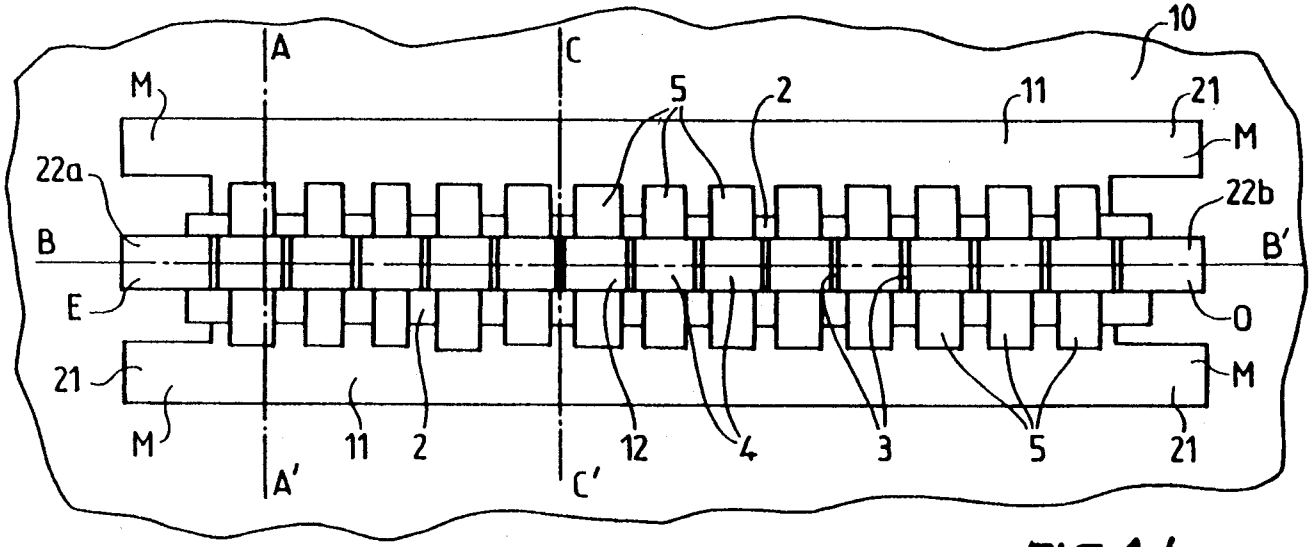
Figure 14B:
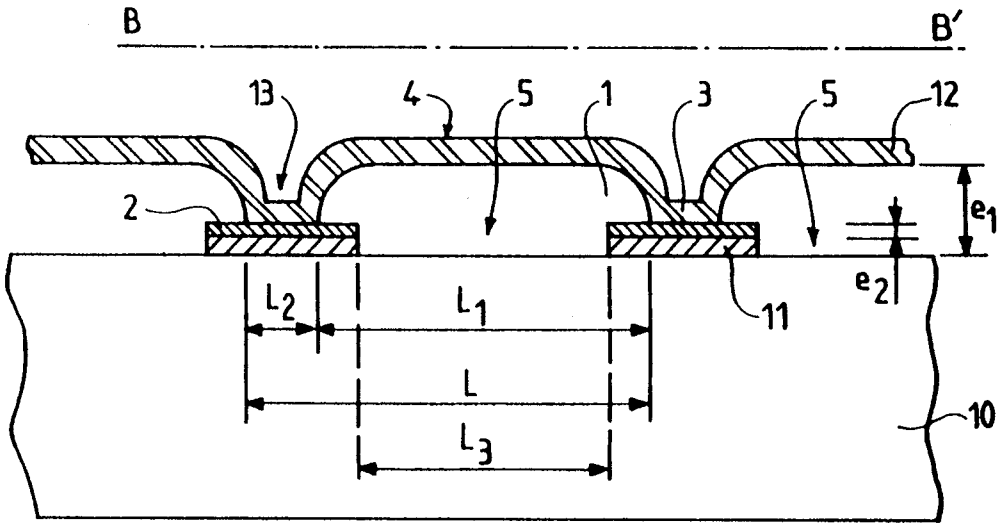

FIG. 14*a* shows a top plan view of a slow-wave line in a tenth embodiment;

FIG. 14*b* shows this line on an enlarged scale along axis BB' of FIG. 14*a;*

Figure 14C:
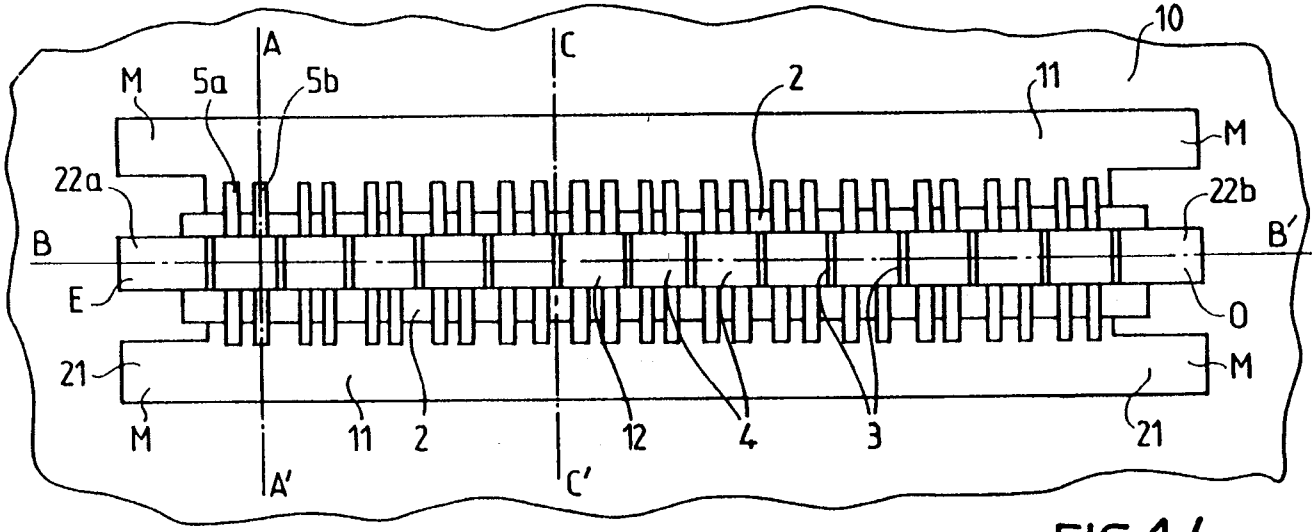
Figure 14D:
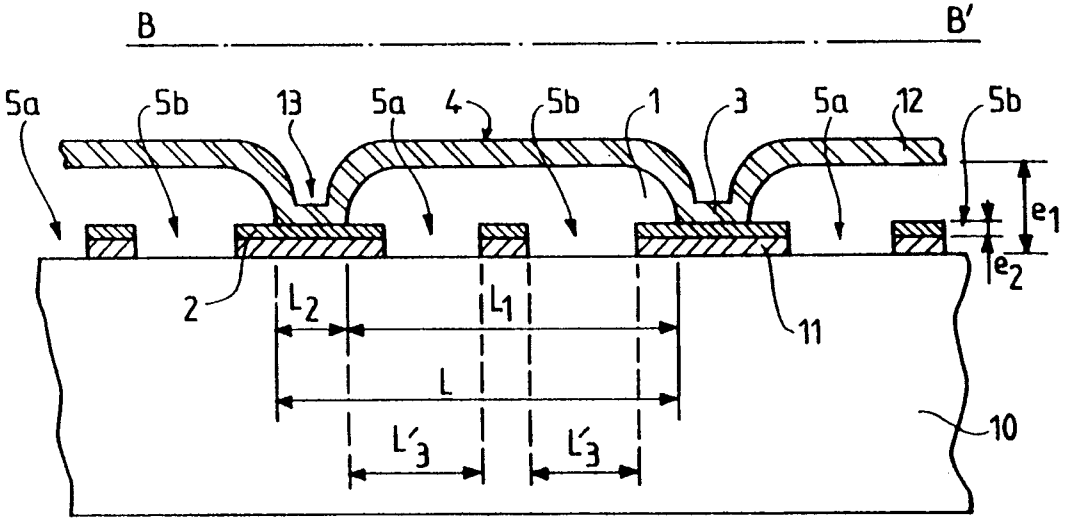

FIG. 14*c* shows a top plan view of a slow-wave line in an eleventh embodiment;

FIG. 14*d* shows this line on an enlarged scale along axis BB' of FIG. 14*c;*

Figure 1A:
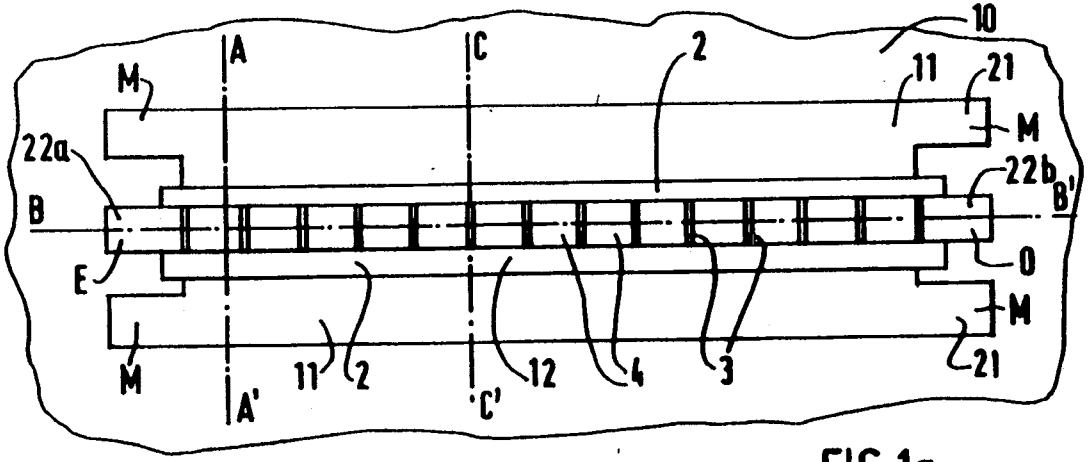
Figure 14E:
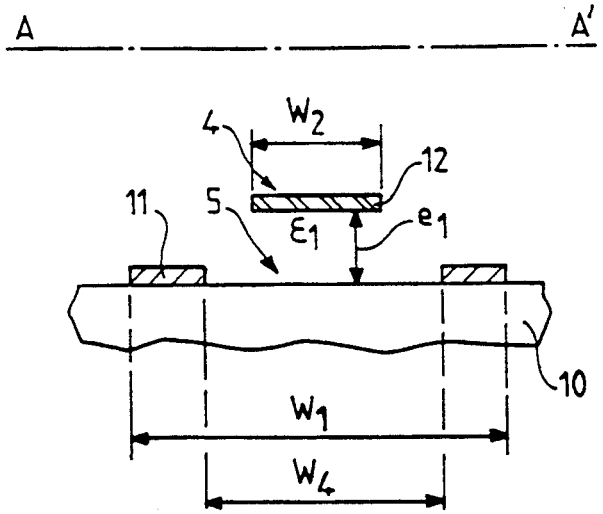
Figure 15C:
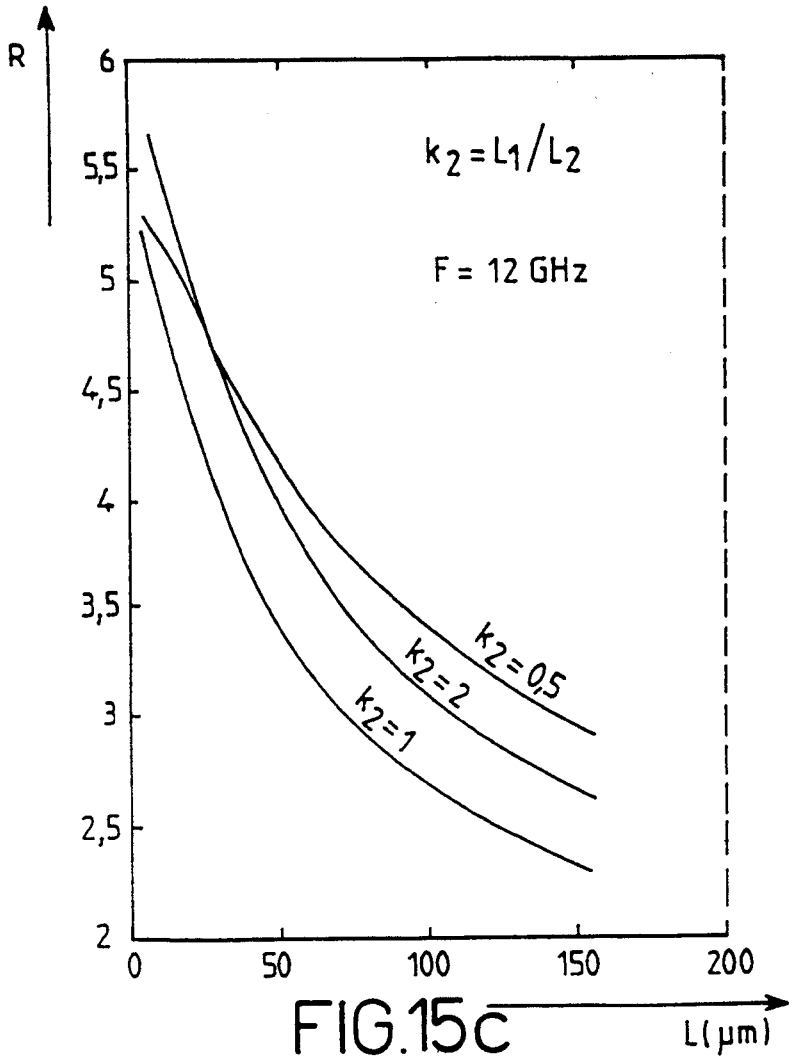
Figure 15B:
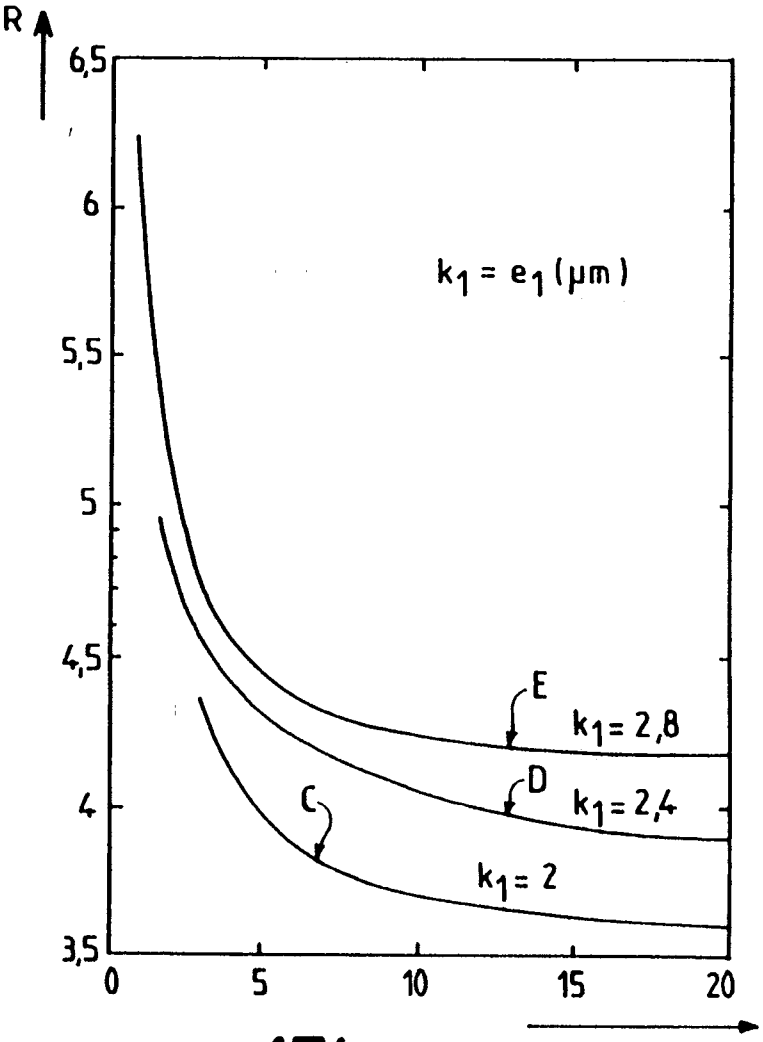
Figure 15A:
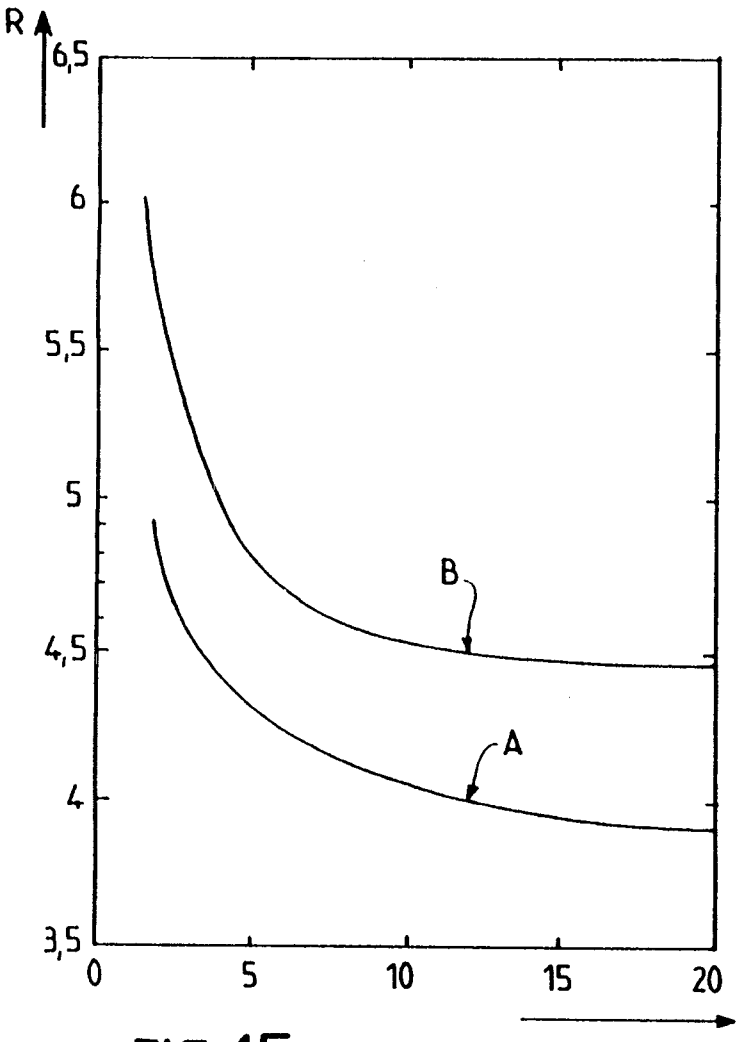

FIG. 14*e* shows the line of FIG. 14*a* and also of FIG. 14*c* in section along axis AA';

FIG. 15*a* shows two curves representing the delay factor R of microwave lines plotted against frequency F, the curve A relating to a microstrip line as shown in FIG. 1*a* without recesses underneath the bridges, and the second curve B relating to a microstrip line having recesses in the ground plane underneath the bridges, such as shown, for example, in FIGS. 14*a* or 14*c;*

Figure 16A:
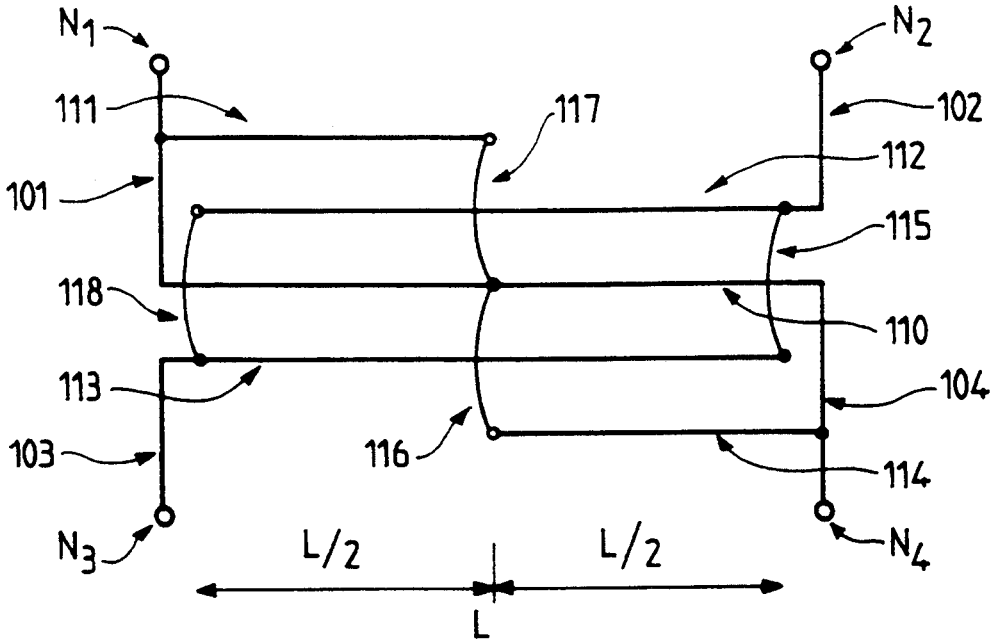
Figure 17:
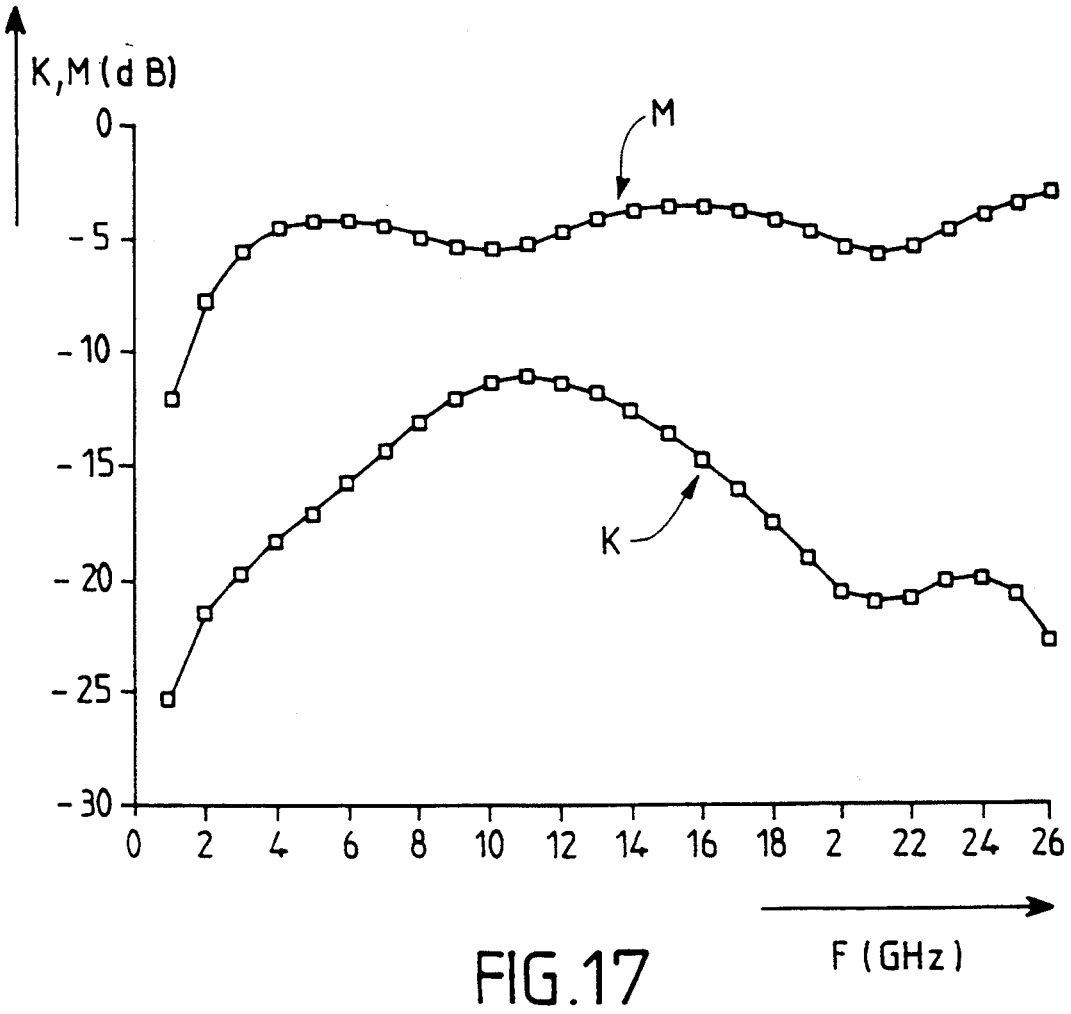
Figure 16B:
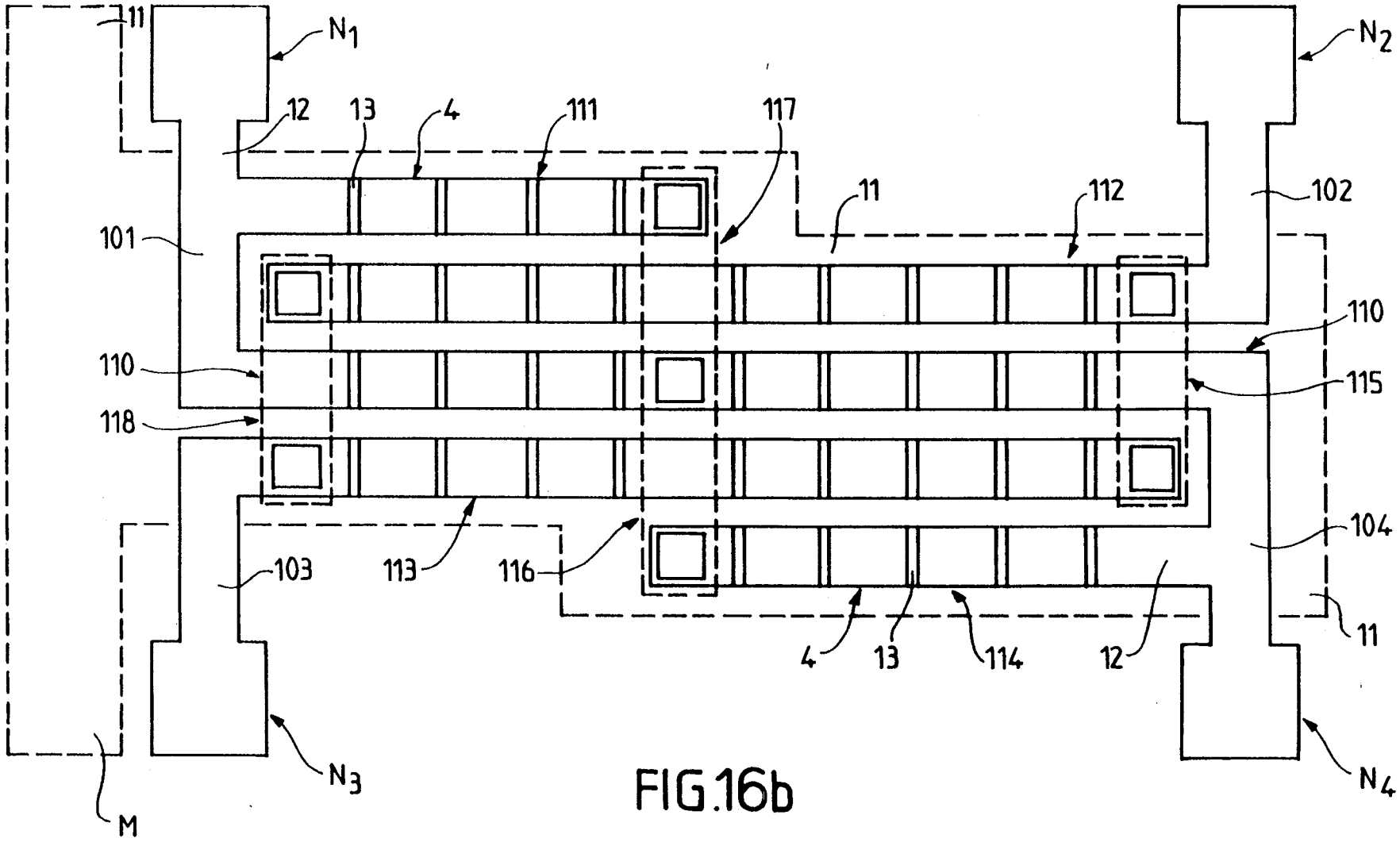
Figure 16C:
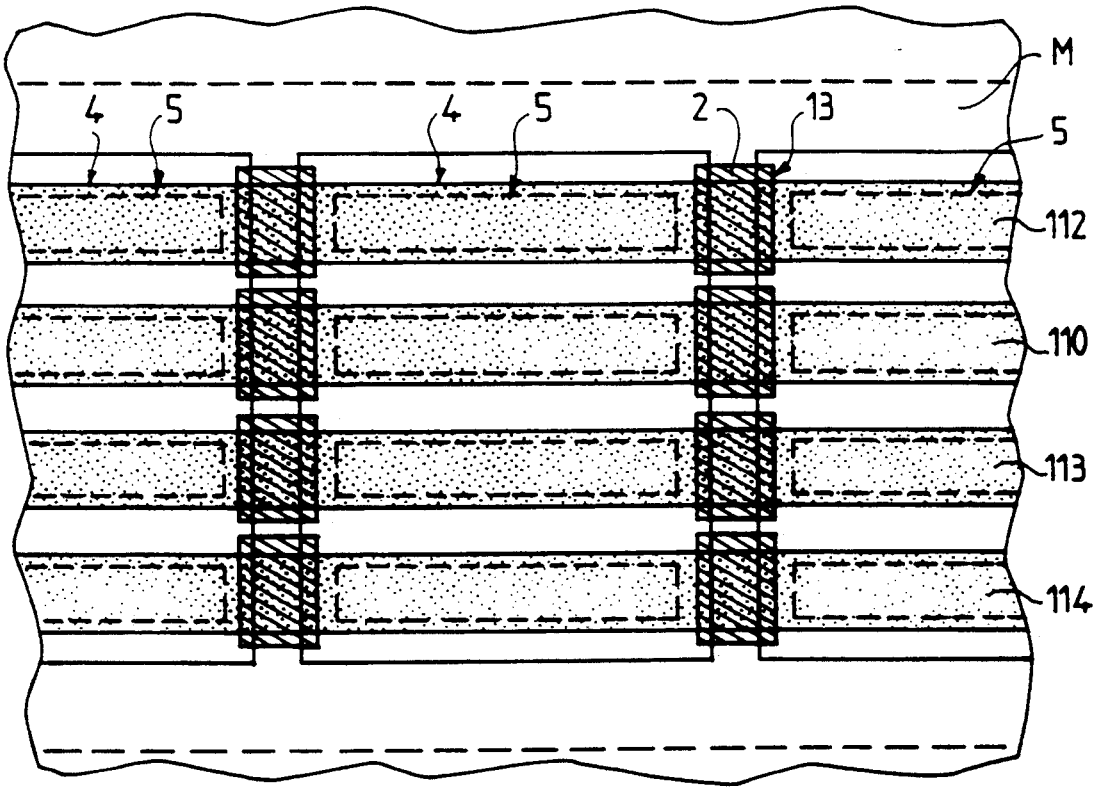
Figure 16D:
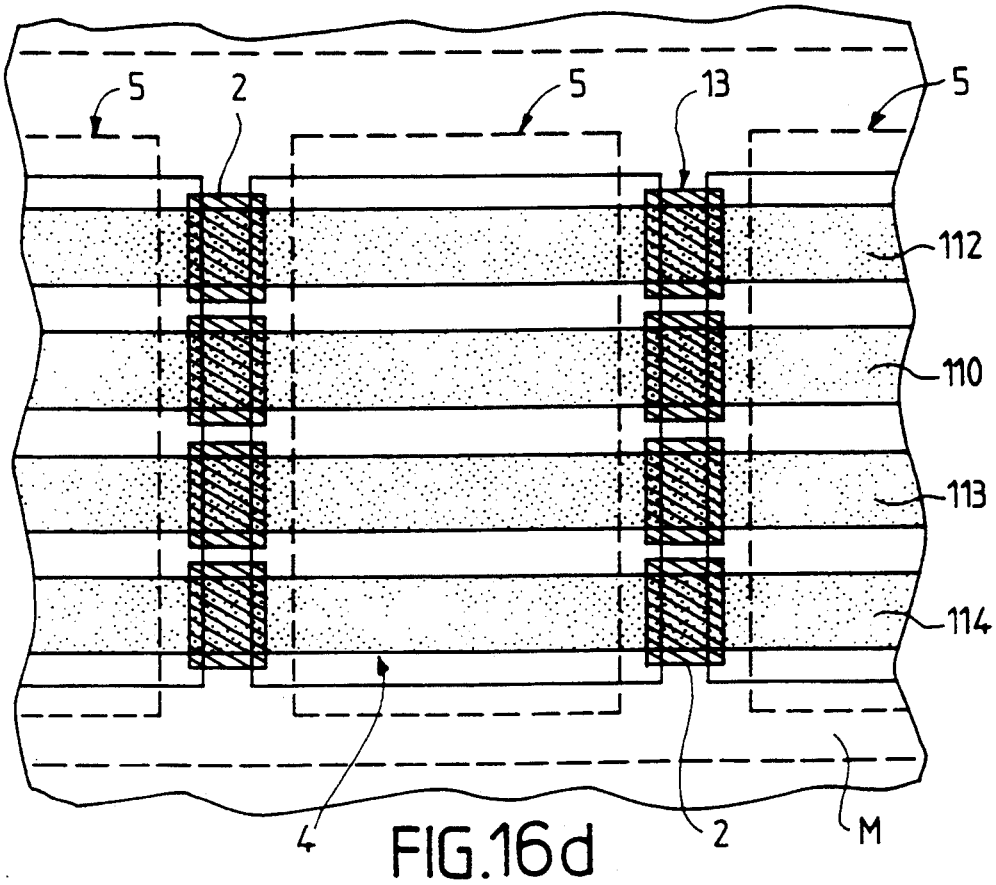

FIG. 15*b* shows 3 curves representing the delay factor R of a microwave frequency line corresponding to the type shown in FIG. 15*a,* plotted against frequency F, and for different values of the parameter constituted by the height $e_1$ of the dielectric 1 underneath the bridges, where the curve C corresponds to $e_1=2$ μm, the curve D to $e_1=2.4$ μm and the curve E to $e_1=2.8$ μm;

FIG. 15*c* shows 3 curves representing the delay factor R of a microwave frequency line in conformity with the type shown in FIG. 15*a,* plotted against Length L, for different values of the parameter constituted by the ratio $L_1/L_2$ where $L_1$ is the length of the bridges and $l_2$ the length of the columns, at a fixed value of the frequency F=12 GHz;

FIG. 16*a* shows a de Lange coupler represented diagrammatically;

FIG. 16*b* shows a top plan view of a de Lange coupler realised by means of lines in conformity with those of FIG. 15*a* in integrated circuit technology;

FIG. 16*c* represents an enlarged version of such a coupler realised in accordance with the first embodiment;

FIG. 16*d* represents an enlarged version of such a coupler when it is realised in accordance with the second embodiment;

FIG. 17 represents two curves, one curve K of the coupling coefficient in dB plotted against frequency F and the other curve M of the tuning coefficient in dB plotted against frequency for a coupler of the type shown in FIG. 16*b;*

Figure 18:
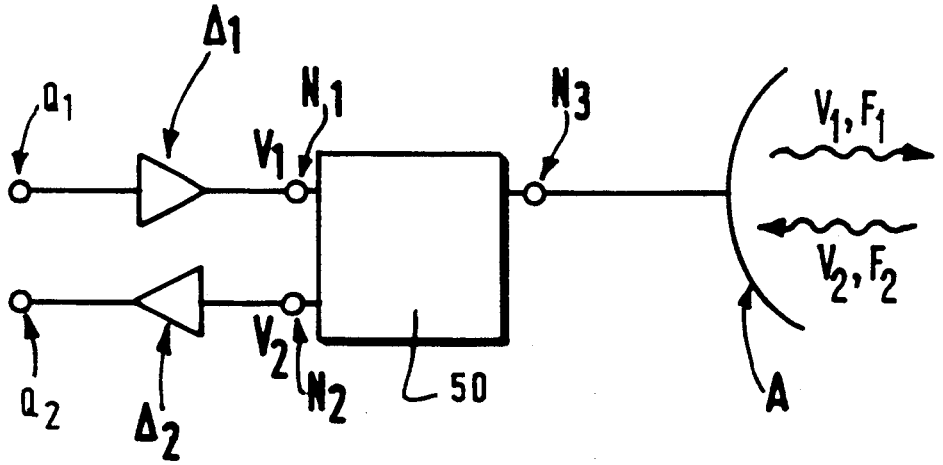
Figure 19:
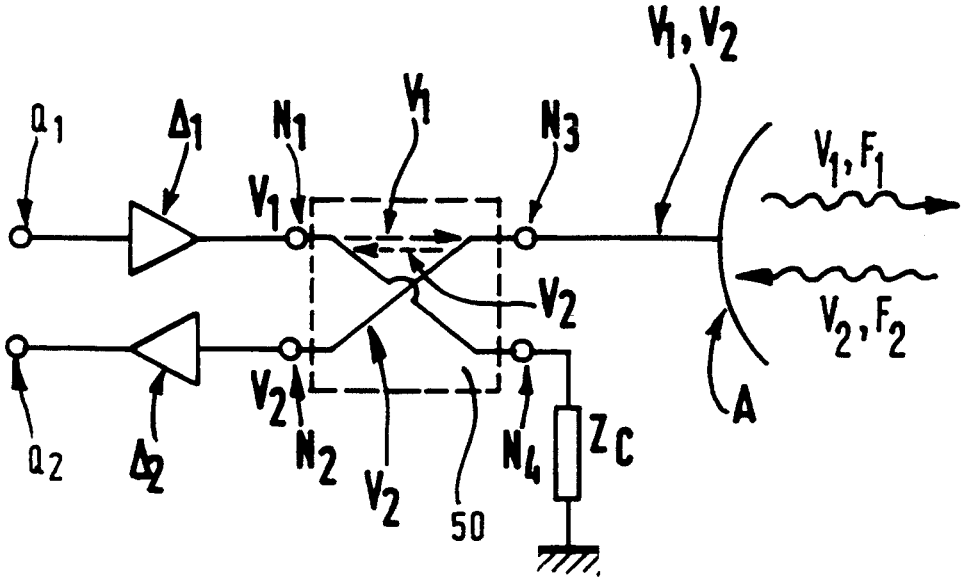
Figure 20:
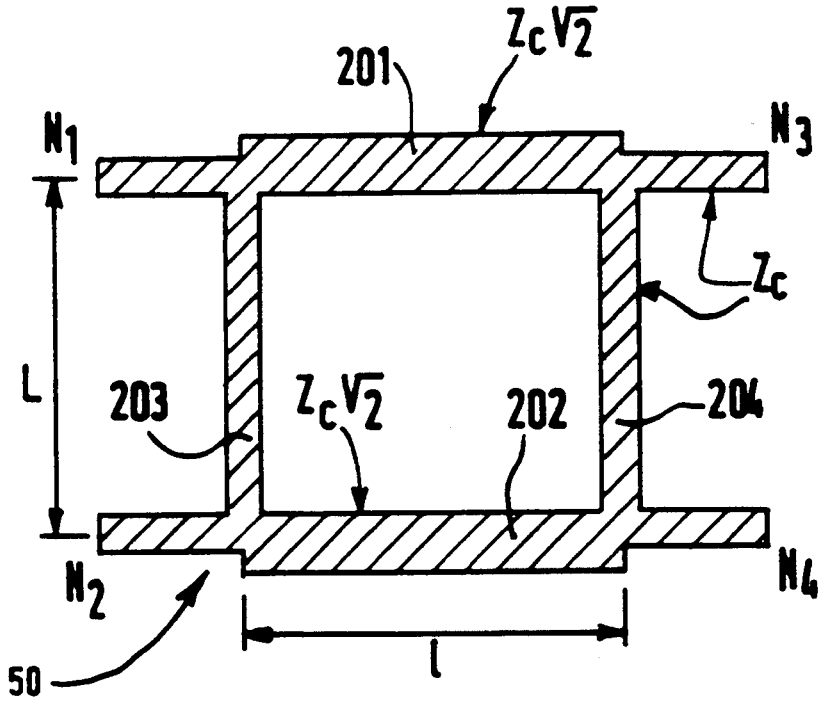

FIG. 18 shows a diagram of a single-aerial transceiver arrangement;

FIG. 19 shows in a diagram a transceiver arrangement comprising a de Lange coupler;

FIG. 20 shows a branch coupler; and

Figure 21:
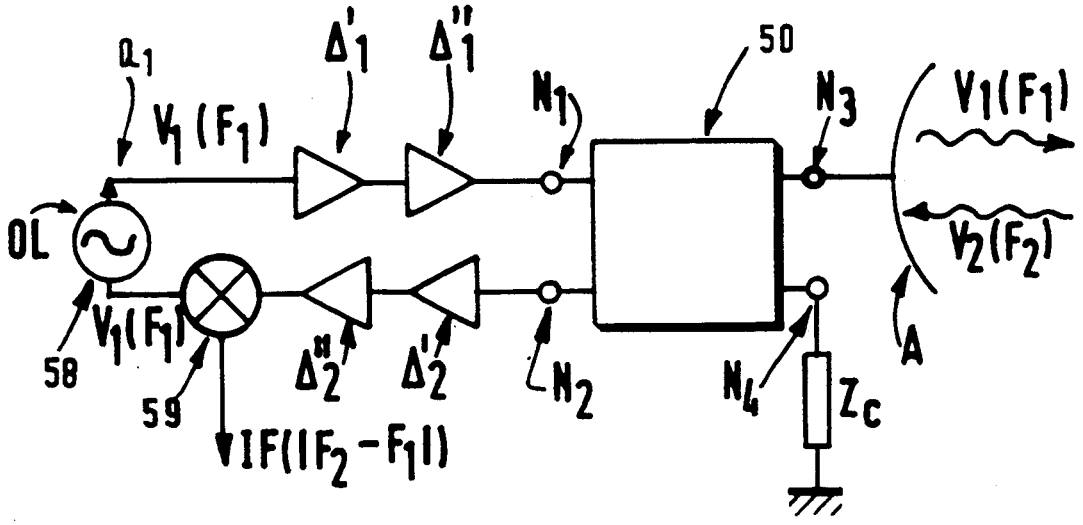

FIG. 21 shows a microwave frequency head circuit in a transceiver module of a radar.

DESCRIPTION OF THE INVENTION

Numerous variants of the slow-wave line according to the invention are possible. All these variants have the essential elements of the invention in common which elements will be explained by means of the description of a first embodiment chosen for its simplicity.

First Embodiment

This embodiment is illustrated by the FIGS. 1*a* and 2 to 6.

FIG. 1*a* shows a top plan view of a slow-wave line having the microstrip structure.

This line is realised on a substrate 10 which may be absolutely any material. For example, the material may be completely insulating, completely conductive, semi-insulating or semiconductive; and this choice is without constrictions as to the material for the substrate which permits applying the invention to all sorts of circuits, in any possible technology when the circuit comprises a transmission line.

On the substrate 10 the line comprises in succession:

a conductive layer 11, for example, of a well conductive metal which may be used as a ground plane having transverse dimension $W_1$;

a dielectric layer 2 having a relative permittivity $\epsilon_{r2}$ and a thickness $e_2$, an overall length at least equal to that of layer 11 and a transverse dimension $W_3$;

a strip of a conductive material, for example, a well-conductive metal 12; this strip 12, having a small transverse dimension $W_2$, forms a periodic structure together with the preceding layers, having a periodicity of L; for this purpose, the conductive strip 12 has three parts 3 which are in contact with the dielectric layer 2, these parts 3 having a longitudinal dimension $L_2$ (parallel to the axis BB'), and parts 4 suspended between two parts 3, these suspended parts 4 having a longitudinal dimension $L_1$(parallel to the axis B—B') so that:

$$L=L_1+L_2$$

the transverse dimensions of the layers 11, 2, 12 are such that:

$$W_2<W_3<W_1.$$

Figure 2A:
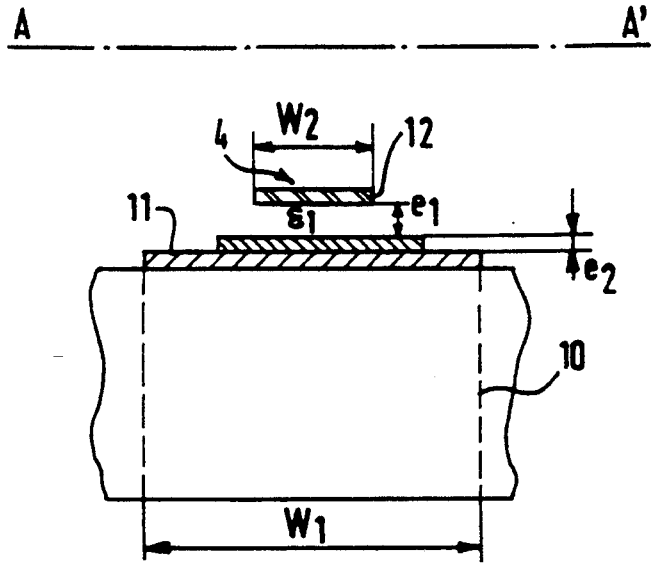
Figure 2B:
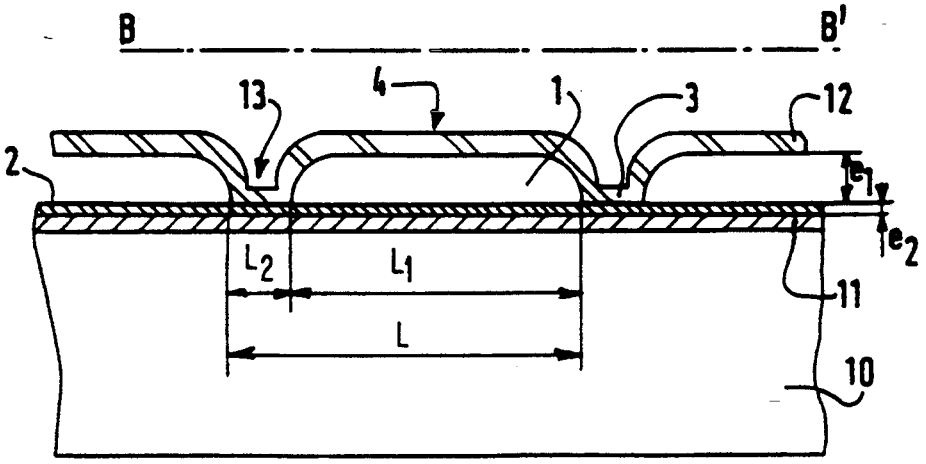

FIG. 2*b* shows a longitudinal section along the axis BB' of the line of FIG. 1*a.* This Figure shows that in the first embodiment a strip 12 is sagged at the location of the parts 3 to provide the contact of the parts 3 of the strip 12 with the dielectric layer 2. On the contrary, in the suspended parts 4, the strip 12 is raised by a height $e_1$ relative to the top surface of the dielectric layer 2.

The suspended parts 4 are the parts in which the propagation takes place. In these parts the strip 12 is raised above a dielectric 1 having a relative permittivity of $\epsilon_{r1}$.

For simplification of the language the following terms will be used hereinafter:

BRIDGES the parts 4 of the strip 12 raised above the dielectric 1, the bridges 4 having a length of $L_1$ and constituting the propagation zones;

COLUMNS the parts 13 formed by the lower conductive layer 12, the dielectric layer 2 having a thickness of $e_2$ and parts 3 of strip 12, the columns 13 forming an MIM (metal-insulation-metal) structure of length $L_2$.

Figure 2C:
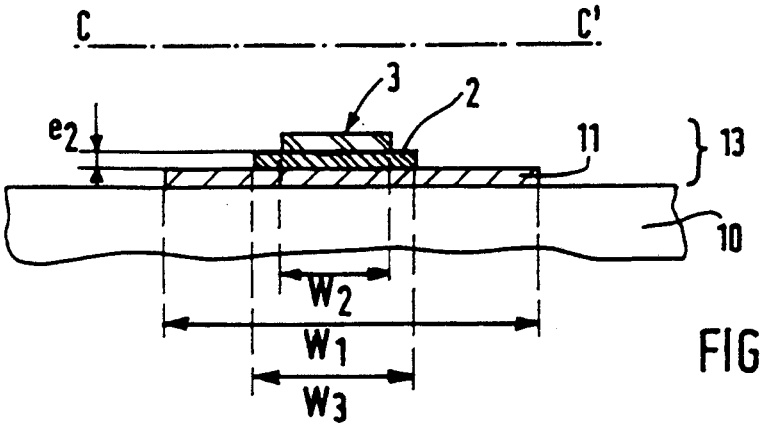

FIG. 2*a* shows a cross-section of the line along axis A—A' of the FIG. 1*a,* at the height of a bridge 4, and FIG. 2*c* shows a cross-section of the line along the axis CC' of FIG. 1*a* at the height of a column 13.

From this first embodiment it is apparent that the main elements for realising a slow-wave line consist in:

a MICROSTRIP line structure comprising a lower conductive layer 11, an upper conductive strip 12 and an intermediate dielectric part 1,2;

the fact that this structure is periodic, having period $L_1$, formed by BRIDGES 4 raised above a first dielectric 1, having a relative permittivity $\epsilon_{r1}$, a length $L_1$, in which bridges the wave propagation is disposed between two COLUMNS 13 formed of a capacitive structure (in this first embodiment the capacitive structure is a MIM structure constituted by the lower conductive layer 11, the dielectric layer 2, with permittivity $\epsilon_{r2}$ and by the conductive strip 12, the columns having a length $L_2$ so that $L_2+L_1=L$; and the values of the parameters: $\epsilon_{r1}$, $\epsilon_{r2}$, $L_0L_1$, $e_1$, the value of the capacitor and $W_1$, $W_2$ of the line structure are linked to provide the slow-wave propagation and produce a considerable phase shift over a total length $\Delta$ of a short transmission line (in the first embodiment the value of the capacitor is linked with $L_1$ and $e_2$).

In addition to these essential elements:

the step 1 of the periodic structure may be constant or not.

Hereinbelow an embodiment of a non-constant step line will be described;

the material selected for realising the substrate has no influence whatsoever on the operation of the line; the substrate is only used as a support;

the pattern of the line may be linear, S-shaped or spiral; any further imaginable design is possible;

the capacitor may be a passive or an active element; and the dielectric layer having the MIM structure may further be formed by two dielectric superimposed layers (*2a*, *2b*). This type of structure of two dielectric layers is known to those skilled in the art and is therefore not represented in the drawing Figures.

It is these characteristics that lead to numerous variations of the slow-wave transmission line, particularly simple to realise and performing well and specially applicable to realising MMIC circuits.

In effect, the slow-wave operation of the line which produces considerable phase shifts over a small length $\Delta$ results in the fact that these lines are more easily integrable than the prior art MICROSTRIP lines.

With a view to evaluating the performance of such a line it is necessary to evaluate the propagation constant $\gamma$ in the line length L.

Hereinbelow the following connotations will hold:

$\gamma_1$, $\gamma_2$ the propagation constants in the part BRIDGE 4 and in the part COLUMN 13 respectively.

$L_1$, $L_2$ the BRIDGE, COLUMN lengths already defined as $L_1+L_2=\lambda$.

$Z_1$, $Z_{,2}$ the characteristic impedances in the parts BRIDGES 4 and COLUMNS 13.

The propagation constant $\gamma$ is linked with losses $\alpha$ in the line and with the phase constant $\beta$ by means of the equation:

$$\gamma=\alpha+j\,\beta.$$

The phase constant $\beta$ in the line is linked with the wavelength $\lambda_g$ of the propagation in the line by means of the equation:

$$\beta=2\,\pi/\lambda_g.$$

The effective permittivity $\epsilon_{reff}$ is linked with the normalized wavelength $\lambda_g\lambda_0$ already defined hereinbefore by: $\epsilon_{reff}=(\lambda_0/\lambda_g)^2=(1/R)^2$, where R is the slow-wave factor.

Figure 3:
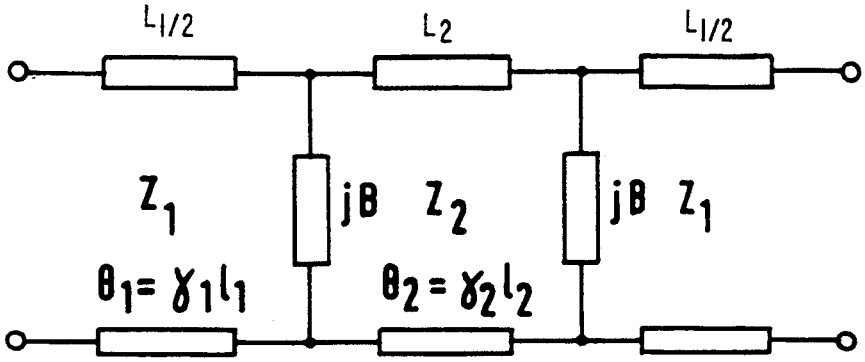
FIG. 3 represents the equivalent circuit diagram of a line shown in FIG. 1.

FIG. 3 represents the equivalent circuit diagram of a unit cell of the line, that is to say, comprising a half BRIDGE, a column and a second half BRIDGE.

One defines $\theta_1=\gamma_1L_1$ a and $\theta_2=\gamma_2L_2$. Alternatively, B is the susceptance of the discontinuity between the BRIDGE 4 on the dielectric 1 and the COLUMN 13 MIM.

When implementing a conventional calculation method which can be applied to periodic structures, the propagation constant $\gamma$ is linked with other parameters of the line defined hereinbefore for the equivalent circuit diagram of the unit cell shown in FIG. 3, by the equation:

$$ch(\gamma\cdot 1)=\{K^{+}ch(\theta_1+\theta_2)+K^{-}h(\theta_1-\theta_2)-B/2(Z_1.+Z_2)\,sh(\theta_1+\theta_2)-B/2(Z_1-Z_2)sh(\theta_1-\theta_2)\}$$

where $$K\pm=(1\pm K) \text{ with } K=Z_2/Z_1+Z_1/Z_2=B^2Z_2Z_1.$$

This equation permits calculating the phase constant $\beta$. The result of these calculations when choosing:

$L_1$, $L_2$ $\epsilon_{r1}$, $\epsilon_{r2}$ $e_1$ and $e_2$ $W_1$ and $W_2$ in an appropriate manner is that the phase velocity of the line is small. Hence the existence of the mode called slow-wave mode.

In order to fulfil the conditions established by these calculations a slow-wave line is realised in this first embodiment in which:

the substrate 10 is semi-insulating so as to integrate the line in the MMIC circuit, the dielectric 1 underneath the BRIDGES 4 is air having a relative permittivity of $\epsilon_{r1}=1$, the dielectric 2 in the columns 13 having the MIM structure is chosen between silicon dioxide ($SiO_2$) and silicon nitride ($Si_3N_4$); under these conditions the relative permittivity of the dielectric layer 2 has a value of the order of 6 for silicon dioxide ($SiO_2$) and a value of the order of 7 for silicon nitride ($Si_3N_4$); these layers 2 will be realised under very strict technological conditions characteristic of integrated circuits so as to obtain such high values for the permittivities $\epsilon_{r2}$; if the technological conditions are less strict, the values may be less high, such as of the order of 4; and the conductive layers 11 and 12 are chosen from the metal layers which ordinarily constitute the first interconnection level of an integrated circuit for the lower conductive layer 11, and for the upper conductive layer 12 forming the strip, a second interconnection level of an integrated circuit.

Thus, in this first embodiment the line can be manufactured together with an integrated MMIC circuit.

However, it is evident that other choices may be made in regard to the materials.

Table I shown below brings together the preferred values of the parameters for using the line in this first embodiment.

TABLE I

| | |
|---|---|
| $\epsilon_{r1}$ = 1(air) | $\epsilon_{r2} \simeq 6(SiO_2)$ or $\simeq 7(Si_3N_4)$ |
| $L_1 \simeq 100\ \mu m$ | $L_2 \simeq l_1/10$ |
| $e_1 \simeq 1.5\ \mu m$ to $2.5\ \mu m$ | $e_2 = e_1/10$ |
| $W_2 \simeq 20\ \mu m$ | $W_1 \simeq 500\ \mu m$ |
| $W_2 < W_3 \leqq W_1$ | |

FIG. 1*a* furthermore shows that the dielectric 2 has a length which is slightly larger than that of the ground plane 11 (which may be connected to ground by the stubs 21) for permitting realization of an input E by means of a stub 22*a* and an output 0 of the slow-wave line by means of a stub 22*b*.

Figure 6:
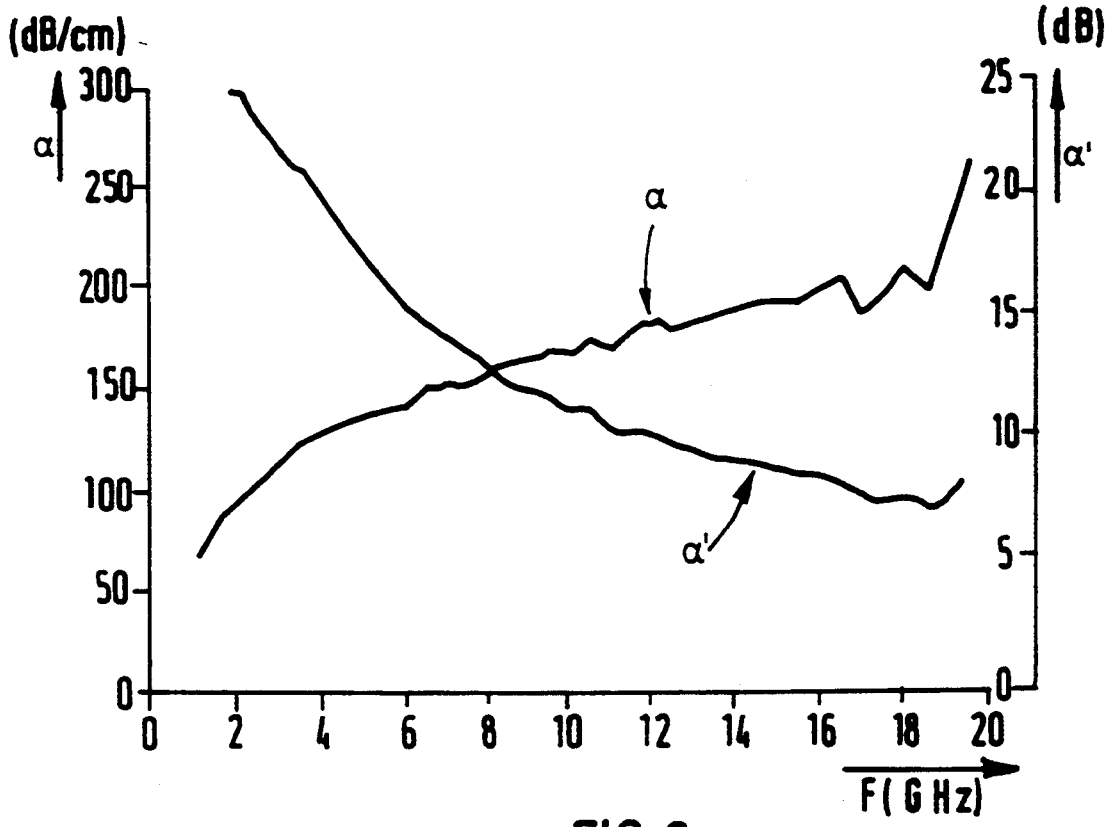
FIG. 6 represents the losses $\alpha'$ in decibels per centimeter (dB/cm) plotted against frequency F in GHz and also represents the losses $\alpha'$ in dB relative to the wavelength $\lambda_g$ plotted against the frequency F.
Figure 4:
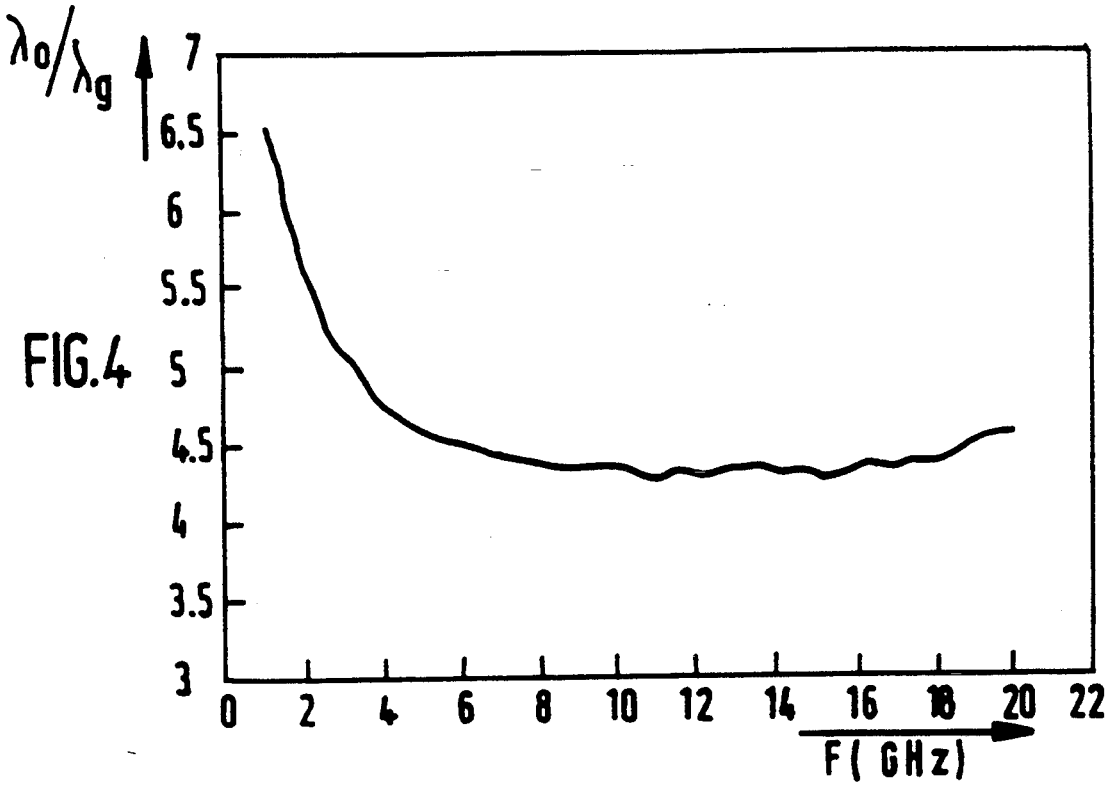
FIG. 4 represents the delay slow-down (or slow-wave factor) $\lambda_0/\lambda_g$ plotted against propagation frequency F expressed in GHz in the first embodiment.
Figure 5:
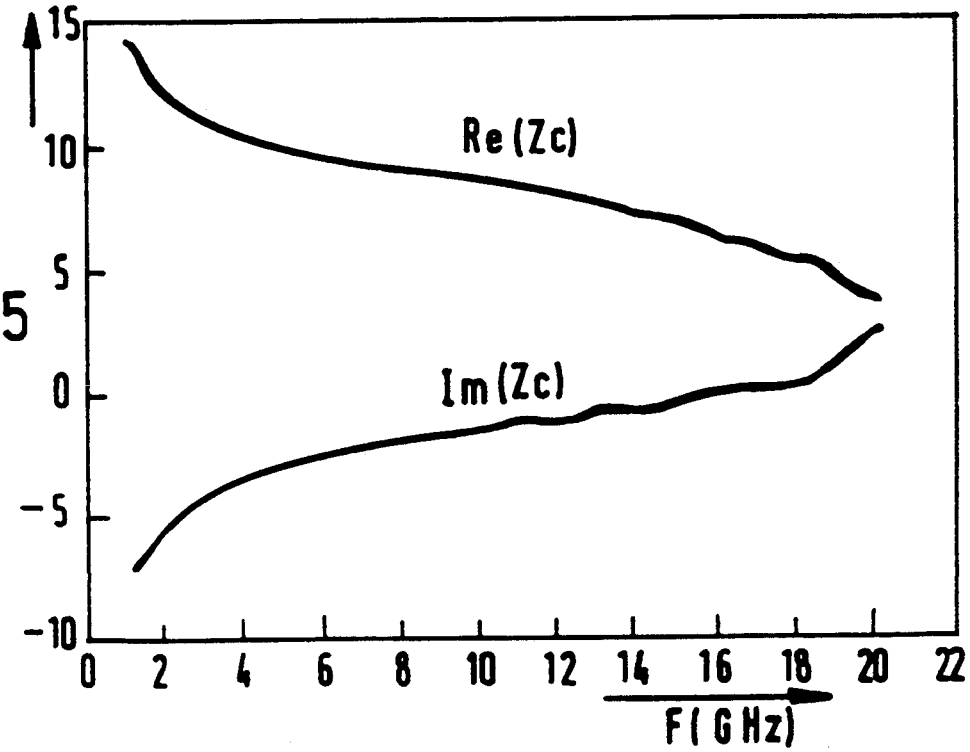
FIG. 5 represents the real portion Re of the characteristic impedance $Z_c$ of the line in the first embodiment, and also represents the imaginary portion Im of this impedance, both plotted against frequency F in GHz.

FIGS. 4, 5 and 6 represent curves demonstrating the performance of a line obtained under the conditions in which the line elements have the values given in Table I.

FIG. 4 shows the slow-wave factor $\lambda_0/\lambda_g$ plotted against frequency F in GHz. From this Figure one deduces that the effective relative permittivity $\epsilon_{reff}$ is very high at low such as frequencies, frequencies, for example, less than 4 GHz which then remain constant between 4 and 20 GHz, at a value of the order of 20. This value is to be compared with effective relative permittivity values known to those skilled in the art for the conventional MICROSTRIP lines, and which are of the order of 6 to 8 when the line is formed on aluminium ($Al_2O_3$) or on a semiconductor.

FIG. 5 represents the real $Re(z_c)$ and the imaginary parts $Im(Z_c)$ of the characteristic impedance $Z_c$ of this line. The real part of the impedance $Z_c$ is extremely low. This line according to the first embodiment will thus find highly interesting applications in the realisation of a low-impedance line for an impedance transformer.

FIG. 6 shows the losses $\alpha$ in the line, expressed in dB/cm, plotted against frequency F in GHz and also the losses $\alpha'$ in dB relative to the wave length $\lambda_g$ plotted against the frequency F. These losses per cm are slightly higher than those of a conventional MICROSTRIP line.

But, since the phase velocity is low, the slow-wave line has a 2 to 4 times smaller overall length $\Delta$ compared with a conventional MICROSTRIP line. Consequently, the performance of the slow-wave line is not deteriorated relative to a conventional MICROSTRIP line, whereas, on the contrary, it presents the advantage of being shorter and thus more easily integrable.

Second Embodiment

Figure 1B:
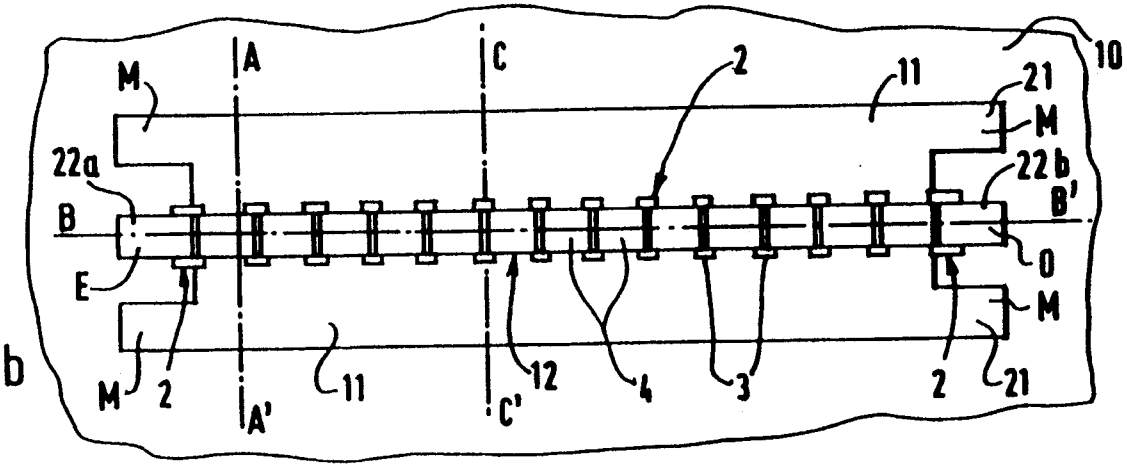
Figure 7:
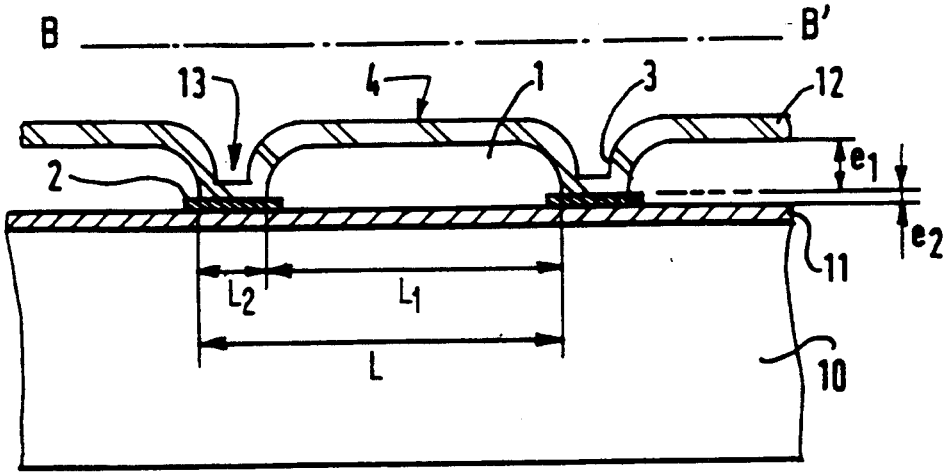
FIG. 7 represents the line of FIG. 1*b* in a longitudinal section along axis B—B' of FIG. 1*b* in the second embodiment.

This example is illustrated by the top plan view of FIG. 1*b* and by the cross-sectional view of FIG. 7 which is a longitudinal section along the axis BB' of FIG. 1*b*.

In the preceding first embodiment the dielectric layer 2 was continuous from one end to the other end of the line. In this second embodiment the layer 2 underneath the BRIDGES may be eliminated. But it is indispensable for realising the MIM structure of the COLUMNS 13. In fact, in the first embodiment its influence under the BRIDGES 4 would be considered negligible.

Third Embodiment

Figure 8:
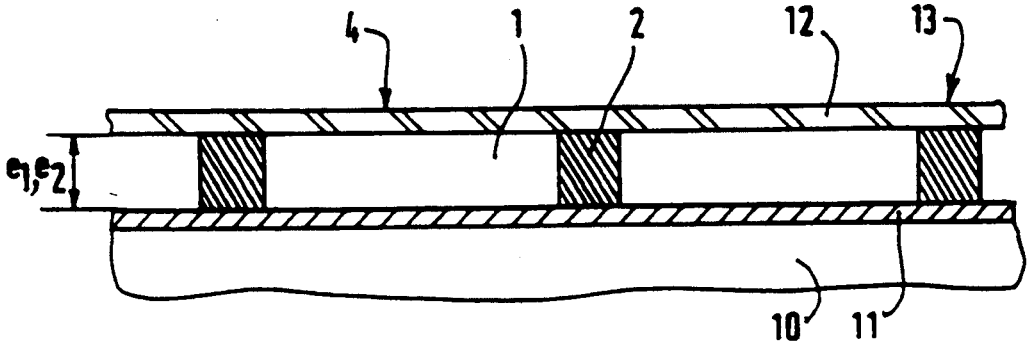
FIG. 8 represents the line described in longitudinal section in a third embodiment.

This example is illustrated by FIG. 1*b* and by FIG. 8.

The slow-wave line does not present any changes in the diagrammatic representation shown hereinbefore and may thus be illustrated by FIG. 1*b*.

FIG. 8 is a cross-section along the axis B—B' of FIG. 1*b* in this embodiment. Along the longitudinal section of FIG. 8 the dielectric 2 of the MIM structure of the COLUMNS 13 has the same thickness as the dielectric 1 disposed underneath the BRIDGES 4. On the other hand, the dielectric layer 2 which could remain underneath the BRIDGES 4 in the first embodiment is to be removed in this third embodiment similar to the possibility shown in the second embodiment.

In order to realise the slow-wave operation because in this case one has chosen: $e_1=e_2$ the other parameters will vary considerably relative to those represented in the Table I. More particularly, the ratios between the lengths $L_1$ and $L_2$ will differ very much. On the other hand, the respective permittivities $\epsilon_{r1}$ and $\epsilon_{r2}$ may be the same as in the first embodiment, and consequently, the dielectrics 1 and 2 may be identical.

Fourth Embodiment

Figure 9:
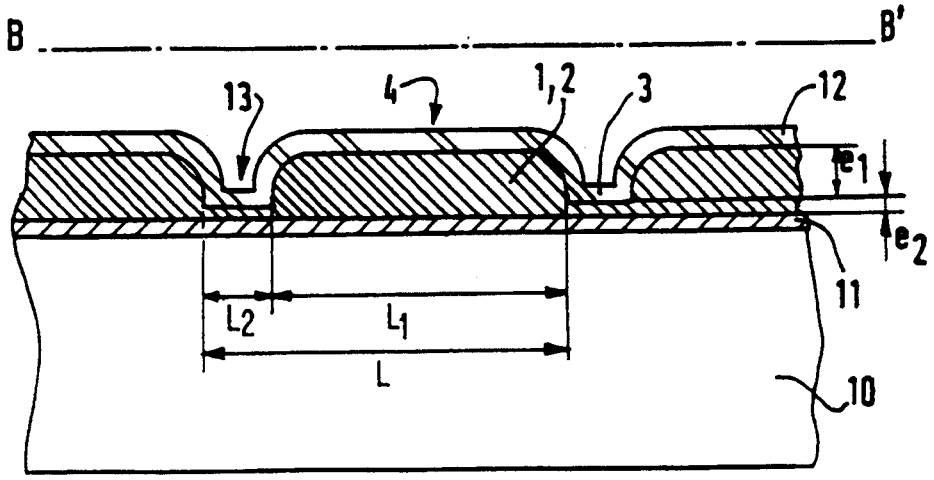
FIG. 9 represents the line described in longitudinal section in a fourth embodiment.

This embodiment may be illustrated by means of FIG. 1*a* in a top plan view and by means of FIG. 9 in a cross-sectional view.

The slow-wave line does not present a change in the diagrammatic representation of the top plan view of FIG. 1*a*.

FIG. 9 is a longitudinal section along axis B—B' of FIG. 1*a* in this embodiment. According to the longitudinal section of FIG. 9 the dielectric 1 and the dielectric 2 are realised by means of the same material and thus present the same relative permittivity:

$$\epsilon_{r1}=\epsilon_{r2}.$$

For realising the operation in the slow-wave mode, the other parameters of the line are thus very different from those whose values are given in the Table I.

More particularly, the ratios between the thicknesses $e_1$ and $e_2$, the ratios between the lengths $L_1$ and $L_2$ will be very different.

Fifth Embodiment

Figure 1C:
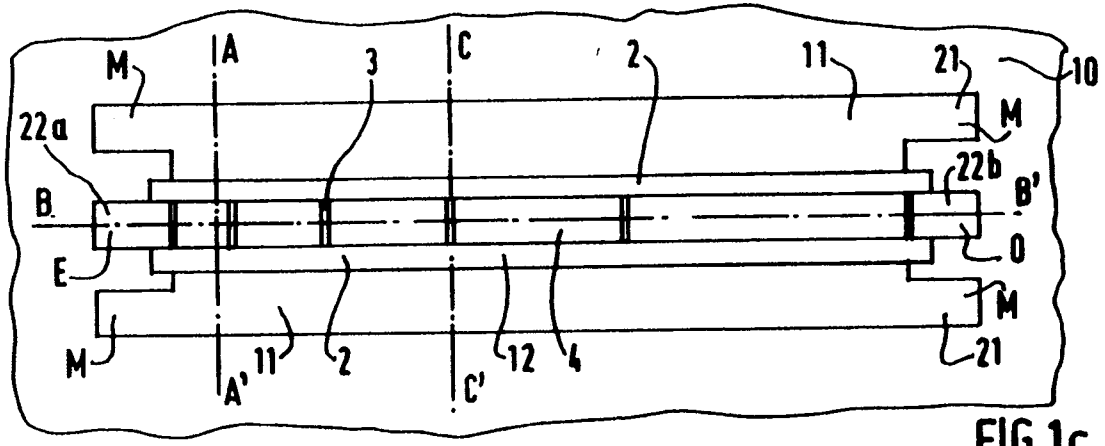
Figure 10:
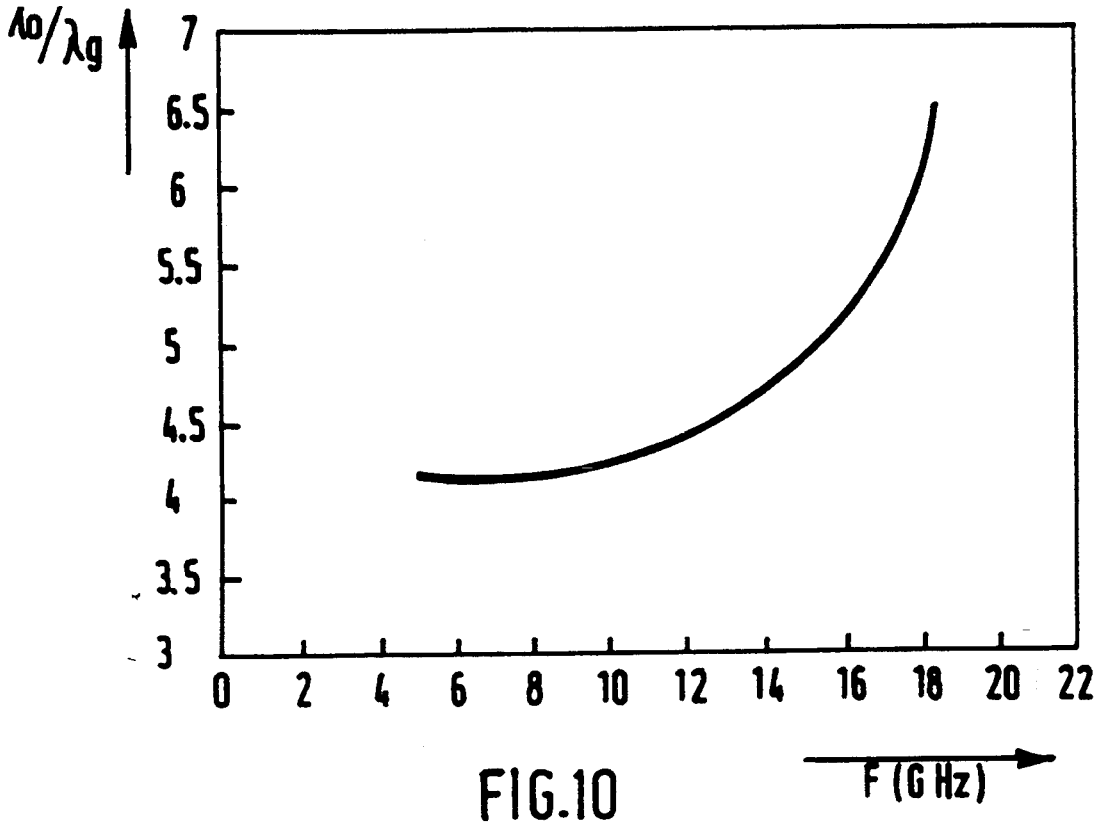
FIG. 10 represents the slow-down factor (or slow-wave factor) $\lambda_0/\lambda_g$ plotted against propagation frequency F expressed in GHz in the fifth embodiment.

This embodiment is illustrated by means of FIGS. 1*c* and 10.

In all the preceding embodiments the curve of FIG. 4 representing the slow-down factor could substantially remain valid when the values of the various parameters are adjusted.

As was searched for, a constant slow-down factor was obtained in all the cases in medium and very high frequencies (4 to 20 GHz). The result was a variation of the phase shift $\beta$ as a function of the frequency F.

By means of the slow-wave line realised according to the principle of the invention a phase shift $\beta$ may alternatively be obtained which remains constant as a function of the wavelength. Therefore, it is sufficient to realise a slow-wave line structure in which the slow-down factor $\lambda_0/\lambda_g$ varies, for example, this slow-down factor showing an increase similar to a hyperbolic form as shown in the curve of FIG. 10.

Under these conditions the phase shift $\beta=2\pi/\lambda g$ will become substantially constant as a function of the frequency F, in the frequency band from 4 to 20 GHz.

This result is obtained by means of the slow-wave line structure diagrammatically shown in a top plan view in FIG. 1*c*.

The main characteristic of this line is that the length L shows an increase and, more specifically, a geometrical increase. The increase factor may be comprised between 1 (1 not being included because then it would be a case of the preceding embodiments) and about 3.

As regards technology as such of such a line having a non-constant length L, an expert may preferably adopt the one of the first embodiment which is particularly easy to use. But nothing prevents creating new variants by applying to this fifth embodiment the teaching taken from the second to fourth embodiments.

Sixth Embodiment

Figure 1D:
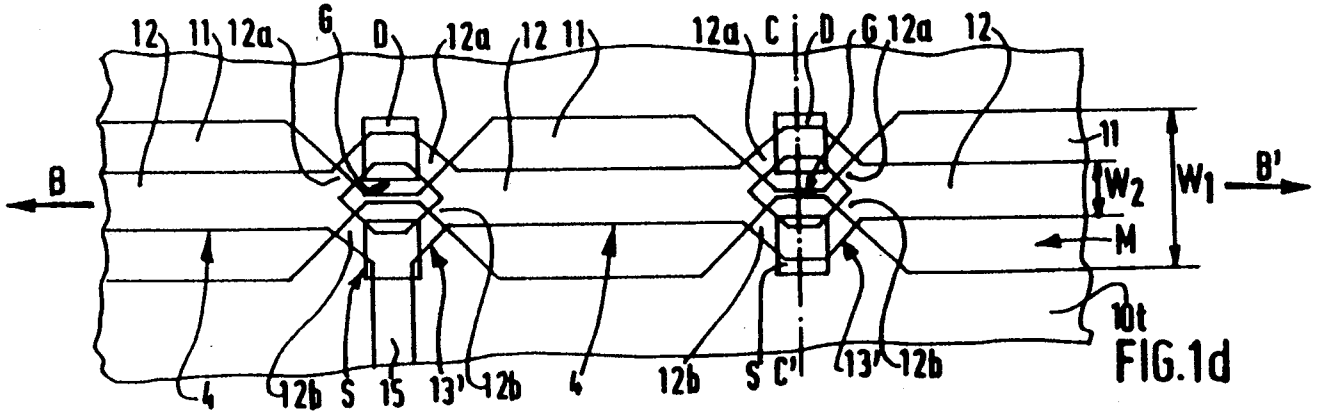
Figure 11:
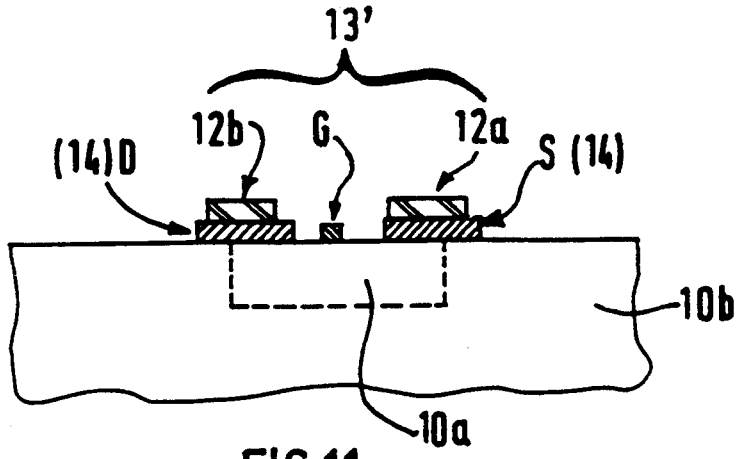
FIG. 11 represents the line along section CC' of FIG. 1*d* in the sixth embodiment.

This embodiment is illustrated by FIG. 1*d* in a top plan view and by FIG. 11 in cross-sectional view.

In the preceding embodiment the expert had the possibility of influencing the phase shift $\beta$ by the use of a particular slow-wave line structure.

In this sixth embodiment a structure is proposed which presents the possibility of electronically influencing this phase shift $\beta$.

As is shown in a top plan view in FIG. 1*d*, the conductive layer 11 itself has a periodic structure of length L. In the regions 13' corresponding to the COLUMNS 13 of FIG. 1*a*, for example, a diode 13' is realised biased by a DC bias voltage $V_{DD}$ which may have different values.

For convenience the diode 13' in the sixth embodiment is a Schottky-gate field effect transistor whose short-circuited source S and short-circuited drain D are connected to the DC bias voltage $V_{DD}$ and whose gate G is connected to ground M. Evidently, in the region of the transistor or diode 13', the substrate 10 is no longer any substrate as in the preceding embodiments but comprises an active zone 10*a* of a semiconductor material, for example, of the conductivity type N while the rest of the substrate 10*b* on either one of the two sides of the active layer 10*a* is semi-insulating. The regions 10*a* and 10*b* may be layers of the material selected from semiconductive material such as: silicon (Si) or gallium arsenide (GaAs) for example. The Schottky gate transistor 13' is, for example, realised in the following manner.

A semi-insulating layer 10*b* and zones 10*a* called active zones are realised by any means known to those skilled in the art of integrated circuits. The active zones 10*a* are realised with a length L chosen for the slow-wave line. The active zones 10*a* present dimensions which are necessary and sufficient for receiving a field effect transistor of the Schottky gate type. This technology is known to those skilled in the art of integrated circuits.

The conductive layer 11 is then realised. Outside the active zones 10*a* the conductive layer 11, whose material is preferably chosen from metals suitable for forming a Schottky gate, has the transverse dimension $W_1$ determined as in the preceding embodiments.

On the other hand, in the active zones 10*a* the metallic layer 11 is narrowed (see FIG. 1*d*). In longitudinal direction, along axis BB' of FIG. 1*d*, it has a dimension called gate width of the Schottky transistor and perpendicular to the axis BB' it has a small dimension of the order of/,tin called gate length of the Schottky transistor. Thereafter, ohmic contacts of a material 14 forming source stubs S and drain stubs D are disposed on either one of the two sides of the gate G according to a conventional field effect transistor diagram of the Schottky gate type. The Schottky gate transistor 13' is illustrated by FIG. 11 in section along the axis CC' of FIG. 1*d*.

The strip 12 is then realised showing bridges 4 in the regions of the metallic layer 12 where the latter's dimension is $W_1$.

For realising the electric contacts between the strip 12 and the ohmic contacts 14 of source S and drain D of each field effect transistor 13' in a particularly interesting embodiment, the strip 12 is divided into two parts 12*a* and 12*b*, for example, where the part 12*a* establishes surface contact of the ohmic contact of source S, and part 12*b* establishes surface contact of the ohmic contact of drain D. The arrangement is symmetrical relative to the axis BB' as well as to the axis CC' of FIG. 1*d*.

In order to avoid short-circuiting between the strip 12 and the metallic layer 11, the parts 12*a* and 12*b* may be constituted by air bridges, or also a thin insulating dielectric layer such as the layer 2 described for the preceding embodiments may be provided at once under the bridges 4 and slightly overlapping the metallic layer 11 in the zones of the Schottky gate, while leaving the ohmic contacts bare on which the strip parts 12*a* and 12*b* come to rest while establishing electric contact.

By means of this method the sources N and drain D of the transistors 13' are short-circuited mid the Schottky gate G is connected to ground M through the metallic layer 11.

It will then be sufficient to provide a connecting line 15 for connecting at least an ohmic contact S or D to an adjustable bias voltage $V_{DD}$.

As already observed above, the strip 12, its parts 12*a* and 12*b* may be realised in any metal suitable for realising the second interconnection levels of the integrated circuits. Consequently, the connecting line 15 connecting the ohmic contacts may be realised according to the same technology.

The phase $\beta$ of the slow-wave line is thus electronically adjustable by adjusting the bias voltage $V_{DD}$ which makes the gate-source capacitance of the transistor 13' vary.

Seventh embodiment

Figure 12:
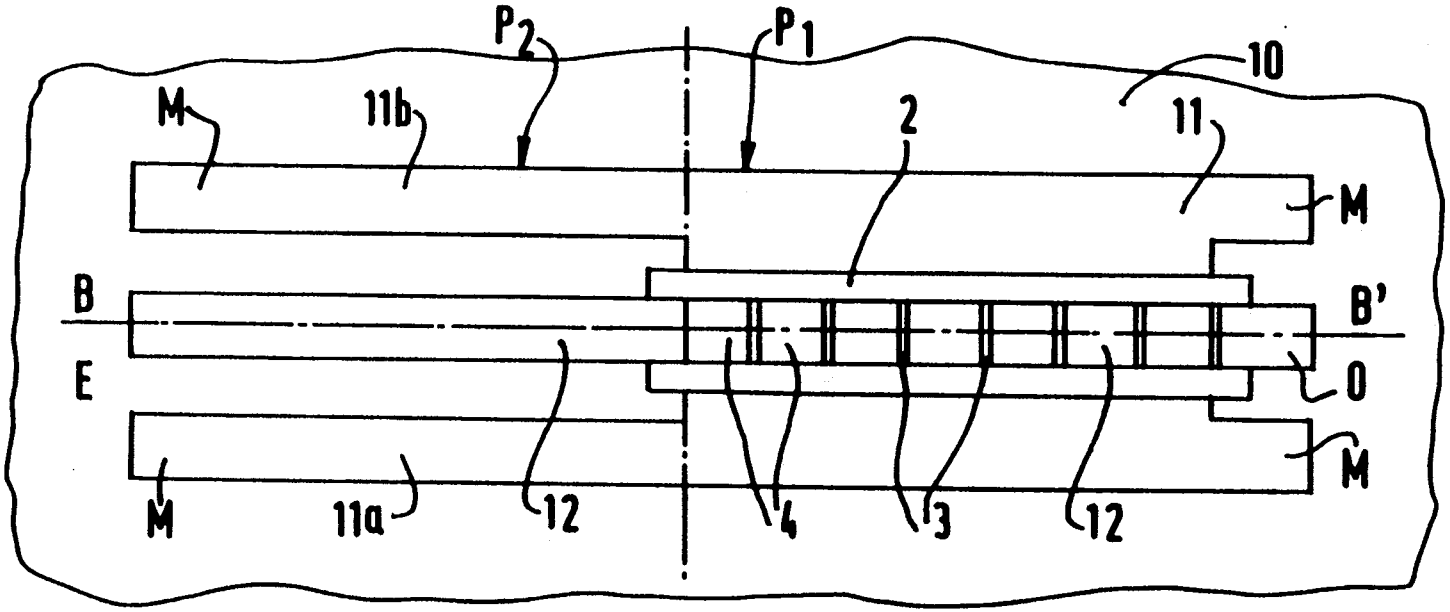
FIG. 12 represents a top plan view in a diagram of a coplanar line connected to a slow-wave line according to the invention.

This embodiment is illustrated by means of the top plan view of the diagram of FIG. 12 .

The slow-wave transmission line whose main elements have been described and of which a certain number of embodiments have been described in the first to sixth embodiments out of a large number of possible variants, solves, as has been observed, for example, two crucial technical problems for using integrated circuits in general and MMIC's in particular, which is to say:

it has a reduced surface;

it can be realised on the main surface of the integrated circuit;

its connections are compatible with planar circuit elements;

its connections are compatible with the elements realised on the main surface of the integrated circuit; and this line specifically has a low impedance.

FIG. 12 represents the connection of such a slow-wave line having low impedance and a reduced surface, to a high-impedance coplanar line.

Each coplanar line is understood to be a line realised on the main surface of the integrated circuit or the MMIC, showing a central strip conductor which has a small transverse dimension disposed between two strip conductors which have a larger transverse dimension. The impedance of the coplanar line depends on the transverse dimension of the central conductive strip having a distance separating this strip from two other strips generally connected to a reference potential or ground. The phase shift (generally expressed as a wavelength, for example $\lambda/4,\lambda/2$) depends on the line length.

Other factors are found in the actual calculation of the characteristic of the line such as: the thickness of the strip and the nature of the substrate.

It is possible to realise both high-impedance lines and low-impedance lines by means of coplanar lines. But, if the high-impedance coplanar lines have dimensions which can be compared with the integrated circuits, the low-impedance coplinear lines have dimensions, especially transverse dimensions, which cover an enormous surface of the integrated circuit which is certainly unfavourable in view of monolithic integration.

The low-impedance slow-wave line thus permits, when calculating its length and its characteristics in an appropriate manner, forming a line that has, for example, the same phase shift as a coplanar line, ($\lambda/4,\lambda/2$).

Thus, when the problem is posed of realising a low-impedance line, the expert has every interest in adopting the structure of one of the slow-wave lines according to the invention as described hereinbefore.

On the other hand, when the problem is posed of realising an impedance transformer, the expert has every interest in adopting the structure shown hereinbefore in FIG. 12, illustrating the connection between a high-impedance coplanar line (for example $\lambda/4$) and a low-impedance slow-wave line according to the invention (also, for example, $\lambda/4$).

In effect, with respect to a coplanar line having the same characteristic, the low-impedance slow-wave line according to the invention will present:

a width reduced by a factor of $\simeq 10$; and a length reduced by a factor of $\simeq 2$ to 4.

As is shown in FIG. 12, the part $P_1$ is the low-impedance slow-wave line according to the invention, and separated by the dash-and-dot line the part $P_2$ is a high-impedance coplanar line as is known to those skilled in the art.

On substrate 10 a first metallic layer forms the ground plane 11 of the slow-wave line $P_1$ and is separated into two strips for forming the ground lines 11*a* and 11*b* of the coplanar line $P_2$.

The slow-wave line $P_1$ will comprise, on the conductive layer 11 a dielectric layer 2 as already described above, overlapping the ground plane 11 of the slow-wave line $P_1$ in the regions necessary for avoiding short-circuiting between the ground plane 11 and the line 12 realised at a later instant.

Subsequently, the slow-wave line $P_1$ comprises the strip 12, which forms, as described above, the columns 13 and BRIDGES 4, and strip 12 is then continued directly over the substrate 10 between the ground lines 11*a* and 11*b* for forming the coplanar structure of the line $P_2$. For this purpose, it is generally necessary for the dielectric layer 2 to overlap the ground plane 11 of the slow-wave line $P_1$ on the side of the coplanar line $P_2$ so as to avoid short-circuiting between the ground plane 11 and the line 12.

If an output O is desired for the slow-wave line $P_1$ on the side opposite to its connection to the coplanar line $P_2$, the dielectric layer 2 is also extended beyond the ground plane 11, and in the strip 12 an output O is provided in FIG. 12 as shown in the FIGS. 1*a*, 1*b* and 1*c*.

Eighth Embodiment

This embodiment is not illustrated.

It has been noticed that the low-impedance slow-wave line included a conductive plane 11, which could be connected to ground, and this plane is in contact with the main upper surface of the substrate.

If so required, the contact with another ground plane realised on the second surface of the substrate, or back of the substrate, may be realised as is known to those skilled in the art by using a metallic hole.

Ninth Embodiment

Figure 13:
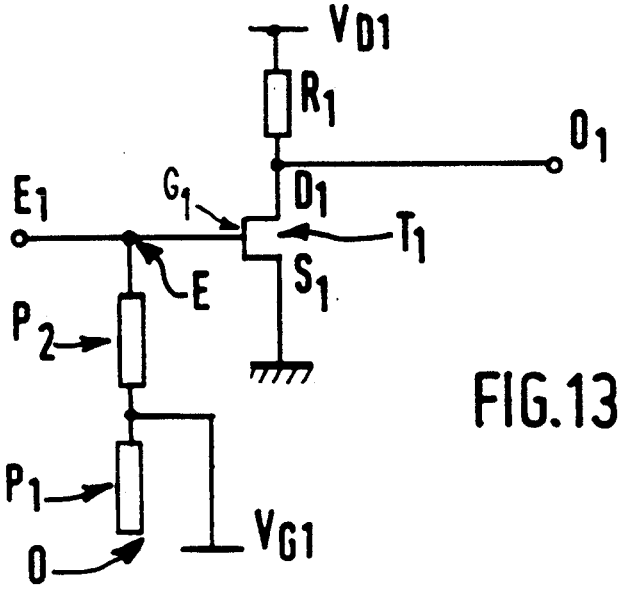
FIG. 13 represents by way of example a circuit in which the arrangement shown in FIG. 12 is used.

In this embodiment, illustrated by means of FIG. 13, an embodiment is shown of how an impedance transformer described with respect to the seventh embodiment can be used in an integrated circuit.

As is represented in FIG. 13, the circuit comprises a transistor, for example, a field effect transistor $T_1$ which has a gate $G_1$ for receiving a signal $E_1$ in a given frequency domain, which has a drain $D_1$ connected to a DC bias voltage $V_{D1}$ through a resistor $R_1$ which has an output $O_1$ for this signal and has a source $S_1$, for example, connected to ground M.

A circuit based on an impedance transformer $P_1+P_2$, may be connected to the gate $G_1$ of the transistor $T_1$.

A high-impedance line $P_2$, for example $\lambda/4$, is connected with one end to the gate $G_1$ and with its other end to a low-impedance slow-wave line $P_1$ according to the invention as well as to the DC bias voltage $V_{G1}$.

The low-impedance line $P_1$ is thus connected with one end to both $P_2$ and $V_{G1}$ while its other end is open in this application.

The slow-wave line according to the invention has a large application potential for any sort of integrated circuits as well as for MMIC's (microwave frequency) because its operation can be insensitive to the substrate as has been observed above, because it has small dimensions relative to other lines having the same characteristics, and because it is compatible with all the integrated circuit technologies used to date.

Tenth Embodiment

This embodiment is illustrated by the FIGS. 14*a*, 14*b*, 14*e*, and 2*c*.

FIG. 14*a* shows a slow-wave line in top plan view, of the microstrip structure having first characteristic features which are identical with those of the line of the second embodiment.

Thus, this line is realised on a substrate 10 which may be formed by whatever material, for example, completely insulating, completely conductive, semi-insulating or semi-conductive.

On the substrate 10 the line comprises in succession:

a conductive layer 11, for example, a well-conductive metal which can be used as a ground plane M and has a transverse dimension $W_1$;

a dielectric layer 2 having a relative permittivity $\epsilon_{r2}$ and a thickness $e_2$ and a transverse dimension $W_3$;

a strip of a conductive material, for example, a well-conductive metal 12; this strip 12 which has a small transverse dimension $W_2$ forms with the preceding layers a periodic structure, having an interval L. For this purpose, the conductive strip 12 has parts 3 which are in contact with the dielectric layer 2, these parts 3 having the longitudinal dimension $L_2$ (parallel to the axis BB'), and parts 4 suspended between two parts 3, these suspended parts 4 having a longitudinal dimension $L_1$ (parallel to the axis B—B') so that:

$$L=L_1+L_2;$$

the transverse dimensions of the layers 11, 2, 12 are such that:

$$W_2 \leqq W_3 \leqq W_1.$$

With respect to the second embodiment this structure additionally comprises an essential element constituted by the parts 5 in which parts the ground plane layer 11 as well as the dielectric layer 2 are recessed underneath the suspended parts 4 so that the stafface of the substrate 10 appears. In this tenth embodiment there is a single recess 5 underneath each suspended part 4 and the longitudinal dimension of the recess 5 is:

$$L_3 \leqq L_1$$

For example, the value of $L_3$ may approach that of $L_1$ to within several %, or be equal thereto.

The structure of the line used in the tenth embodiment appears more clearly from the enlarged diagrammatic representation given in FIG. 14b in longitudinal section along the axis BB' of the line of FIG. 14a. This Figure shows that the strip 12 sags at the location of the parts 3 to affect the contact between the parts 3 of the strip 12 and the dielectric layer 2. On the other hand, in the suspended parts 4, the strip 12 is raised by a height $e_1$ relative to the top surface of the substrate which appears in the recess 5.

The suspended parts 4 are the parts in which the propagation takes place. In these parts the strip 12 is suspended above a single dielectric 1 having a relative permittivity of $\epsilon_{r1}$.

As observed with respect to the second embodiment, the following terms will be used:

BRIDGES, the parts 4 of the strip 12 suspended above the dielectric 1, the bridges 4 having a length $L_1 \simeq L_3$ and constituting the propagation zones;

COLUMNS, the parts 13 formed by the lower conductive layer 12, the dielectric layer 2 having a thickness of $e_2$ and parts 3 of the strip 12, the columns 13 forming a MIM structure (Metal Insulation Metal) of length $L_2$.

FIG. 14e shows a cross-section of the line along axis A—A' of FIG. 14a, at the point of a bridge 4, and FIG. 2c remains valid for showing a cross-section of the line along axis CC' of FIG. 14a at the point of a column 13.

From this tenth embodiment it appears that the essential elements for realising a slow-wave line consist of and lie in:

a microstrip line structure comprising a lower conductive layer 11 forming the ground plane M, an upper conductive layer 12 and an intermediate dielectric part 1, 2;

the fact that this structure is periodic, has an interval $L_1$, formed by suspended BRIDGES 4, of length $L_1$, these bridges in which the wave propagation takes place between the COLUMNS 13 having a capacitive structure. In this tenth embodiment the capacitive structure is a MIM structure constituted by the lower conductive layer 11, the dielectric layer 2, the permittivity $\epsilon_{r2}$ and the conductive strip 12, the columns having a length $L_2$ so that $L_{2+1}=L$ which is the interval of the structure:

the fact that underneath the bridges 4 in the dielectric layer 2 and the ground plane 11 at least a single recess 5 is formed having a length of:

$$L_3 \leqq L_1;$$

the values of the parameters: $\epsilon_{r1}$, $\epsilon_{r2}$, $L_1$, $L_2$, $L_3$, $e_1$, the value of the capacitor and $W_1$, $W_2$, $W_3$ of the line structure are linked with each other so as to result in the slow-wave propagation and produce a considerable phase shift over a total length $\Delta$ of a short transmission line.

In this tenth embodiment the value of the MIM capacitors of the parts 13 is linked with $L_2$, with $e_2$ and with $\epsilon_{r2}$. On the other hand, the recesses 5 made in the regions of the bridge 4 play the role of inductors, making it possible to increase the characteristic impedance of the line.

In addition to these essential elements:

the step L of periodic structure may be constant or not;

the material selected for realising the substrate has no influence whatsoever on the operation of the line; the substrate is merely used as a support;

the line may have a linear structure, a meandering structure or a spiral-shaped structure; any other imaginable design is possible;

the capacitor may be passive or active. In the tenth embodiment a passive element is preferred for making the line more compact; the lines which include active elements have other properties explained hereinbefore;

furthermore, the dielectric layer of the MIM structure may be formed by two superimposed dielectric layers. This type of structure with two dielectric layers for providing a capacitor is known to those skilled in the art and is thus not represented in the drawings.

All these characteristic features which lead to a large number of variants of this slow-wave transmission line which is particularly easy to realise, performs particularly well as already explained, for example, by means of the descriptions of the first to fifth embodiments.

In this tenth embodiment, compared to the first or second embodiment, the augmentation of the slow-down factor with respect to that of the characteristic line impedance really permits an optimum diminishing of the line dimensions.

In order to evaluate the performance of such a line it is necessary to evaluate the propagation constant $\gamma$ over the line length L, or interval L.

Hereinafter the following will be denoted: $\gamma_1$, $\gamma_2$: the respective propagation constants in the part BRIDGE 4 and in the part COLUMN 13.

$L_1$, $L_2$ the lengths of the BRIDGES, COLUMNS already defined as $L_1+L_2=L$, $L_3$ is the length of the recesses underneath the BRIDGE equivalent to $L_1$, $Z_1$, $Z_2$ the respective characteristic impedances in the parts BRIDGES 4 and COLUMNS 13.

The calculation of the phase constant $\beta$ is performed in the same manner as explained with reference to the first embodiment. The result of these calculations when appropriately selecting $L_1$, $L_2$, $L_3$ $\epsilon_{r1}$, $\epsilon_{r2}$ $e'_1$ and $e_2$ $W_1$ and $w_2$, is a low phase velocity of the line. Hence the existence of the mode termed slow-wave mode already described with respect to the first embodiment.

But it has appeared that the way in which an expert could influence an $\epsilon_{r1}$ and $e_1$, which are essential parameters, was limited because to date the propagation lines of the microstrip type have always comprised the superpositioning of three layers: a ground plane M, a dielectric layer and a conductive microstrip layer as has been precisely described with respect to the first embodiment.

This 3-layer structure resulted from a constant state of the art teaching and this teaching was an obstacle to an evolution which permits obtaining an improvement with respect to the afore-mentioned slow-wave structure.

The problem was thus to find an electronic solution for augmenting the slow-wave factor for reducing the line dimensions even more, which likewise permits reducing the wavelength losses and augmenting the integration densities even more, all this without adding to the considerable technological problems.

Experiments have shown, as appears from the curves shown in FIG. 15*b* which represent the variations of the slow-down factor $R=\lambda_0/\lambda_g$ plotted against frequency F, for different values $k_1$ and the height $e'_1$ of the dielectric 1 underneath the bridges, that is to say:

for the curve C, $e'_1=2$ μm for the curve D, $e'_1=2.4$ μm for the curve E, $e'_1=2.8$ μm that the slow-down factor R augments when the thickness $e'_1$ of the dielectric 1 augments for the same value of frequency F.

However, since it is desirable to actually augment the height $e'_1$ of the bridges, the expert will rapidly come up against a latent technological problem, for if one chooses the air to be the dielectric 1 because air is the best dielectric, it becomes hazardous to realise the above bridges of a certain value of $e'_1$, which maximum value evidently depends also on the length $l_1$ and the width $W_1$ of the conductor 11.

In order to solve this problem in a satisfactory manner according to the invention an augmentation of the characteristic impedance of the line has been realised by forming the recesses 5 in the ground plane M underneath the bridges, which recesses 5 augment the inductive role of the line constituting the bridge.

Furthermore, one thus has parameters which could be influenced according to the first embodiment for augmenting the slow-down factor, that is to say, $e_1$, $\epsilon_{r1}$, of the additional possibilities due to the self-inductor effect of these recesses.

FIG. 15*a* represents the slow-down factor $R_1=\lambda_0/\lambda_g$ of the lines plotted against frequency F;

curve A represents the factor R in the case of a line according to the first embodiment: without recesses;

curve B represents this factor R in the case of a line according to the tenth embodiment with recesses 5.

These curves distinctly show that the effect from the recesses is beneficial and very important. The expert will foresee that the realisation of such recesses underneath the bridges will produce an additional augmenting effect on the slow-down factor R and this without causing greater disadvantages than the advantages anticipated from the augmentation of this parameter R, such as, for example, additional losses or unwanted wave disturbances. In effect, the expert knows that once one parameter in a system comprising a rather large number of parameters is varied, it becomes difficult to foresee the precise effect obtained, even in the case where computer simulations can be realised. Actually, in the latter case one is always inclined to suppose that certain parameters are negligible in theory which in practice turn out not to be negligible at all.

The recesses 5 produce the favourable desired effect of an additional slowing down while at the same time influencing the characteristic impedance of the line, the thickness of the dielectric $e'_1$ underneath the bridges, the value of the permittivity $\epsilon_{r1}$ as the only most favourable dielectric may be found underneath the bridges, and all this while making use of a simple technology, the recesses 5 have been realised during conventional stages of integrated circuit technology.

Thus, a distinct improvement is additionally obtained with respect to the first and second embodiments in a simple and elegant manner without running the risk of envisaging insuperable values for the height $e'_1$ of the bridges.

The curves of FIG. 15*c* represent the slow-down factor $R=\lambda_0/\lambda_g$ g plotted against the interval L of the lines, for a given value of the frequency F (in this example, F=12 GHz and $\epsilon_1=1$, for different values of the parameter $k_2=L_1/L_2$ where $L_1$ is the length of the bridges and $L_2$ the length of the columns in this tenth embodiment, with $L_3 \simeq L_1$.

The curves of FIG. 15*c* denote that there is an optimum value where R passes through a maximum, which depends on the other line parameters, and with which the expert may thus influence these parameters for an optimization of the system.

The diminishing of the dimensions of the line is such that the expert may then think of incorporating complex devices using these lines in high density integrated circuits. This was impossible beforehand. The components using the lines were realised on substrates on either one of the two sides of the microwave integrated circuits and connected by thin wires which limited the cutoff frequency. On the other hand, when given the possibility of realising the lines on the same substrate as the microwave transistors and other components of the integrated circuits, the connections are technologically identical with those of the rest of the circuit and they no longer limit the frequency.

In order to satisfy these conditions established by these calculations, in this tenth embodiment one has realised a slow-wave line which has the same technological characteristic features as those of the first embodiment, for example, the same materials.

However, it will be evident that other choices as to the materials used may also be made.

The Table II to be given hereinafter brings together the preferred values of the parameters for using the line in this tenth embodiment.

TABLE II

| | |
|---|---|
| $\epsilon_{r1}$ = 1(air) | $\epsilon_{r2} \simeq 6(SiO_2)$ or $7(Si_3N_4)$ |
| $L_1 \simeq 100$ μm | $L_2 \simeq L_1/10$ |
| $e'_1 \simeq 1.5$ μm to 2.5 μm | $e_2 = e_1/10$ |
| $W_2 \simeq 20$ μm | $W_1 \simeq 500$ μm |
| $L_3 \leqq l_1$, preferably $L_3 \simeq 90$ μm to 96 μm | |
| $W_2 < W_3 \leqq W_4 \leqq W_1$ | |

FIG. 14*a* shows that the other characteristic features of the lines of the tenth embodiment can be very well compared to those of the line of the first and second embodiments shown in FIGS. 1*a* and 1*b*.

FIG. 5 is also valid for representing the real parts and imaginary parts $Re(Z_c)$ and $Im(Z_c)$ respectively, of the characteristic impedance $Z_C$ of this line.

FIG. 6 is also valid for giving a representation of the losses α in the line, expressed in dB/cm, plotted against frequency F in GHz. Curve α' of this FIG. 6 represents the losses in dB per wavelength.

Since the phase velocity is lower, the slow-wave line has a total length Δ which is smaller than the line of the first embodiment. The reduction of the line is inversely proportional to the slow-down factor R. In the case where a conventional microstrip line had a value of about 12 GHz, R was of the order of 2.5, whereas R was of the order of 4 in the line described with reference to the first embodiment. In the tenth embodiment as is shown in FIG. 15*a* and having this frequency, R is of the order of 4.5 as has been observed with respect to the first embodiment, while the performance of the slow-wave line according to the invention has not deteriorated although it is distinctly shorter.

For example, for a 180° phase shift in the frequency band KU, the present slow-wave line structure produces losses evaluated at about 1 dB.

Eleventh Embodiment

This embodiment is illustrated by means of the FIG. 14c in a top plan view and the FIG. 14d which is a section along the axis BB' of the FIG. 14c.

In the preceding tenth embodiment the case has been studied where only a single recess 5 is provided underneath each bridge. In this embodiment, several recesses 5a, 5b etc. are realised underneath each bridge thus creating a cycle in the interval $L_1$.

The advantages are that the slow-down factor R is additionally increased due to discontinuities thus realised.

A variant of this eleventh embodiment which is based on the same principle, is to provide different and alternate values along the line for the capacitors 13. One will thus also obtain a cycle in the line interval and a consecutive improvement of the slow-down factor of the line.

On the other hand, it is also possible to realise a line having at the same time the characteristic of two or more recesses 5a, 5b etc. underneath the bridges, and capacitors having alternate values, for the columns 13. When varying these different factors, the expert will easily obtain the most appropriate results for each envisaged application.

Twelfth Embodiment

In this embodiment one of the slow-wave lines described above is used for realising a de Lange coupler.

The coupler, known from the publication from IEEE, MTT December 1969, pp. 1150–1151, is constituted by at least 3 parallel lines with alternate lines tied together for forming an interdigitated structure. The above publication shows a 3 dB coupler with 5 transmission lines. An electromagnetic field coupling appears between the adjacent parallel lines.

FIG. 16a hereinafter diagrammatically represents this coupler. FIG. 16b represents the same coupler realised by means of integrated circuit layers in a top plan view and in a simplified diagram.

As is represented in FIG. 16a, the coupler comprises two poles termed inputs $N_1$ and $N_2$, and two poles termed outputs $N_3$ and $N_4$. According to FIG. 16a, the de Lange coupler is constituted by 5 parallel microstrip lines, of which one line termed main line 110 is electrically connected to the lines 111 and 114, and two lines 112 and 113 are electrically interconnected to form an interdigitated structure because the line 112 is disposed between the lines 110 and 111 and the line 113 between the lines 110 and 114. The coupler is symmetrical: that is to say, if $N_3$ and $N_4$ are inputs, $N_1$ and $N_2$ are outputs.

The lines 110 and 111 are electrically connected directly to the pole $N_1$ over a simple conductor 101. The lines 110 and 114 are electrically directly connected to the pole $N_4$ over a simple conductor 104. The line 112 and the line 113 are electrically connected to the poles $N_2$ and $N_3$ respectively, over simple conductors 102 and 103.

Thus:

the middle of the main line 110 is connected to an open end of the branch 111 and also to the open end of the branch 114;

the open end of the line 112 is connected to the point shared by the line 113 and the conductor 103;

the open end of the line 113 is connected to the point shared by the line 112 and the conductor 102.

In this structure the poles $N_2$ and $N_3$ are electrically connected cross-wise to the poles $N_1$ and $N_4$ as shown in FIG. 16a and 16b.

Alternatively, the adjacent lines 110 and 112 and 110 and 113 are parallel over a length L whereas in the interdigitated structure 110, 111, 112, the line 111 is parallel to the line 112 over a length equal to L/2. This also holds for the interdigitated structure 110, 114, 113 where the line 114 is parallel to the line 113 over a length equal to L/2.

The length L may be of the order of a quarter of the wavelength λ of the signal transported according to the prior art.

The lines 111, 112, 110, 113, 114 of the de Lange coupler may be realised by means of slow-wave transmission lines according to the invention. In the FIG. 16b the connections 115, 116, 117 and 118 are formed by means of a conductive layer disposed on a different level of the layers 11 and 12, with openings in the layer 12 at the spots provided for establishing the electrical connection with the layer 12 according to a technique called VIA technique well known to those skilled in the art and with insulating layer portions in these parts where, on the other hand, the electrical connection is not desired with the layers 11 or 12. The other simple connections may be formed by means of parts of the conductive layer 12.

FIG. 16c represents an enlargement of a part of the coupler shown in FIG. 16b, in which it appears that the lines used by way of non-limiting example for realising the coupler of the twelfth embodiment are those described with respect to the tenth embodiment.

In the case of FIG. 16c, the recesses 5 of the lines are realised separately underneath each bridge 4.

FIG. 16d represents an enlarged portion of the coupler shown in FIG. 16b in which it appears that the recesses 5 of the parallel lines, for example, 112, 110, 113, 114 can be regrouped for forming a single recess 5, the bridges 4 being arranged opposite to each other for all the lines and the columns 13 likewise. This arrangement has a technological advantage over the preceding arrangement because of its simplicity of realisation; in effect, the mask with respect to the recesses 5 is less critical to locate. This coupler thus uses the same operating principle as the prior-an coupler. When realising the lines necessary for the formation of such a de Lange coupler, by means of slow-wave lines according to the invention, there will furthermore be the advantages of this arrangement performing well and being very compact, compatible with the high-density integrated circuits and low-cost circuits for the public at large, in the domain of television or automotive industry, for example.

FIG. 17 shows in curve M the adaptation of the coupler in dB plotted against frequency F, and in curve K the coupling in dB plotted against frequency F. These curves show that when realising the coupler by means of lines of the tenth embodiment this coupler may advantageously be used in a large frequency domain around 12 GHz.

Thirteenth Embodiment

As represented in FIG. 18, a conventional transceiver arrangement known to those skilled in the art has an input $Q_1$ for a first signal $V_1$, having the frequency $F_1$, propagating through an amplifier $\Delta_1$ then through a duplexer 50, to the aerial A, then to the exterior. This signal is applied to the pole $N_1$ of the duplexer 50 and leaves this duplexer 50 through the pole $N_3$.

This arrangement further has an output P2 for a second signal $V_2$ having the frequency $F_2$. This signal is first captured by the same aerial A and is then propagated through the duplexer 50, which it enters at the pole $N_3$, and through an amplifier $\Delta_2$ towards the output $Q_2$.

The problems posed in microwave transceivers, that is to say, operating up to frequencies around 60 GHz, reside in the fact that:

a) a single aerial is to be used for reasons of economy;

b) the transmitted signal $V_1$ generally has an amplitude which is much higher than that of the received signal $V_2$;

c) there must not be any intermodulation;

d) the arrangement is to have a very good adaptation;

e) the losses are to be very low;

f) the operating frequency is high if so required, for example, 60 GHz;

g) the arrangement is to be integrated and, if so required, h) the frequency band is to be wide.

In this thirteenth embodiment these problems are solved when using as a duplexer 50 a de Lange coupler according to the twelfth embodiment, connected to the other circuit elements in a manner special to the invention.

According to the invention two signals $V_1$ and $V_2$ having two different frequencies $F_1$ and $F_2$ are sent through this coupler. Since the de Lange coupler has a wide band, above 1 octave, the difference between the frequencies $F_1$ and $F_2$ is not disadvantageous if it remains below this passband, for example, below 1 octave. However, the length L of the main line will be chosen as a function of the wavelength $\lambda$, of the weakest signal, generally $V_2$.

In variations of the invention, when the coupling factor is to be augmented, a structure of the de Lange coupler may be provided which has several interdigitated structures similar to the ones formed by the lines 111 and 112, on the one hand, and 113 and 114, on the other hand. The coupler is to present a center of symmetry.

The increase of the number of pins makes it possible to increase the coupling factor and diminish the losses in the coupler. Thus, with 4 pins (or 5 lines), the losses are 3 dB; with 6 pins (or 7 lines) the losses are 2 dB, etc.

On the other hand, the increase of the number of pins makes it also possible to augment the passband of the arrangement.

According to the invention, in order to realise the transceiver arrangement, the first signal $V_1$ having the frequency $F_1$ is applied to the pole $N_1$ of the de Lange coupler as represented in FIG. 16*b* and leaves through the pole $N_3$ to be transmitted to the exterior by an aerial A.

The second signal $V_2$, having the frequency $F_2$, captured by the aerial, is applied to the de Lange coupler on the same pole $N_3$ (so as to resolve the problem of the use of a single aerial) and leaves the coupler through the pole $N_2$.

The fourth pole $N_4$ of the de Lange coupler is connected to ground through an impedance $Z_C$.

Thus, according to the invention, the conductor 101 (or pole $N_1$) is an input, the conductor 102 (or pole $N_2$) is an output, the conductor 104 (or pole $N_4$) is isolated and the conductor 103 (or pole $N_3$) is an input one time and an output the other.

Although, according to an application known to those skilled in the art, the conductor 103 is only an input and the conductors 101 and 102 are only phase-shifted outputs, the conductor 104 itself is isolated.

The coupler is connected as shown in FIG. 19 to an aerial A and also to amplifiers $\Delta_1$ and $\Delta_2$.

Thus, for achieving the object of the invention, as is shown in FIG. 19, the transmit signal $V_1$, having the frequency $F_1$, is processed by a high-gain and high-isolation amplifier $\Delta_1$, and the received signal $V_2$, having frequency $F_2$, is processed by a low-noise amplifier $\Delta_2$. In this case the operation of the transceiver arrangement is the following.

The signal $V_1$ to be transmitted at the frequency $F_1$ between a node $Q_1$ of the transceiver arrangement is then processed by the amplifier $\Delta_1$. Thereafter, since the poles $N_1$ and $N_3$ are coupled, it then passes through pole $N_3$.

The signal $V_1$ to be transmitted at the frequency $F_1$ further travels directly as a result of conduction to the characteristic impedance $Z_C$ connected to the output pole $N_4$.

The signal $V_1$ to be transmitted at the frequency $F_1$ is then propagated from the pole $N_3$ of the coupler to the exterior by means of the aerial A.

The latter receives the second signal $V_2$ at a different frequency $F_2$, generally having a much lower amplitude than the first signal $V_1$ having the frequency $F_1$. This second signal $V_2$ travels, by means of conduction, directly from the input-output pole $N_3$ to the output pole $N_2$. Then the second signal $V_2$ is processed as observed above by means of the low-noise amplifier $\Delta_2$ and leaves the arrangement at the node $Q_2$.

The second received signal $V_2$ having the frequency $F_2$, however, also travels to pole $N_1$ because of the coupling of the poles $N_3$ and $N_1$, but it has a low amplitude, on the one hand;

and, on the other hand, it is located after the pole $N_2$ before the output of the high-gain and high-isolation amplifier $\Delta_1$. It can thus no longer be found back at the input node $Q_1$.

Therefore, the object of the invention, which is to make a transmission of the signals $V_1$ and $V_2$ possible without intermodulation, is achieved.

If the novel use of a de Lange coupler proposed by the invention is considered with respect to that known from the state of the art, in fact only the signal $V_2$ is processed in a rather traditional manner. In effect, for this signal, $N_3$ is an input and $N_1$ and $N_2$ are coupled and phase-shifted outputs. The use of the signal $V_1$ in the system according to the invention is then completely original.

In effect, on the one hand, when used according to the invention, the signal $V_1$ is not processed at all in the known traditional manner. And, on the other hand, the state of the art no longer teaches simultaneous use of two different signals such as $V_l$ and $V_2$ in the same coupler.

An original concept of this use thus resides in the fact that two signals $V_1$ and $V_2$ are applied to the coupler at once, and have different frequencies and amplitudes, and resides in effecting a signal propagation without intermodulation.

The advantages obtained by the use of a de Lange coupler arranged according to the invention are numerous:

by means of this structure, because the de Lange coupler is a passive element, non-linear effects of the active arrangement (distributed amplifier) known from the state of the art are eliminated;

the de Lange coupler is integrable because of its dimensions, contrary to other passive elements known to those skilled in the art under the name of circulators, which also permit a signal separation but which, due to the fact that they are not integrable, are excluded from future technologies;

the isolation of the pole $N_1$, as against the pole $N_2$, is very good (20 to 35 dB);

the losses are low (1 to 3 dB);

the adaptation is very good (better than 25 dB);

the "traces" of $V_2$ at the pole $N_I$ can no longer be found back at the input node $Q_1$;

thus, there is no longer intermodulation between the signals $V_1$ and $V_2$;

the losses may be minimized as required as observed hereinbefore, and the frequency band may be selected to be wider or less wide, by influencing the factors w, s, L of the de Lange coupler, where $w=w_2$ of the preceding embodiments, and where s is the space between the lines of the coupler;

the structure of the de Lange coupler according to the invention is easy to use and of a low manufacturing cost level;

this technology is certainly compatible with the MMIC (Monolithic Microwave Integrated Circuits) integrated circuit technology.

In an embodiment one will choose for the use in the higher frequency domain:

$Z_C=50$ Ohms $w=9$ microns $L\simeq 200$ μm for 60 GHz or also 1.5 mm for 10 GHz $s=7$ microns A de Lange coupler of prior-art microstrip technology may also be used in the same manner as described hereinbefore, but its dimensions are larger.

Fourteenth Embodiment

In this embodiment, the objects of the invention are achieved by using as a duplexer 50 a coupler having branches as described, for example, in the publication entitled "Millimeter Wave Engineering and Applications" by P. BHARTIA and I. J. BAHL published by John Wiley and Sons, New York (A Wiley-Interscience Publication) p. 355, or also from the publication in the Microwave Journal, July 1988, p. 119 and pp. 122–123, entitled "Microstrip power dividers at ram-wave frequencies" by Mazen Hamadallah (p. 115).

As described in these publications, and illustrated hereinafter by means of FIG. 20, a branch coupler comprises two line sections 201 and 202 having length L and impedance $Z_C\sqrt{2}$, connected at each of their ends to two line sections 203 and 204 having impedance $Z_C$ and length L.

In a series arrangement with the first line sections 201 and 202 there are line sections for forming the poles $N_1$ and $N_2$, on the one hand, and $N_3$ and $N_4$, on the other hand, having each an impedance of $Z_C$.

According to above documents, $L=\lambda/4$ where λ was the wavelength of the single input signal applied to a pole, for example, $N_3$. The pole $N_4$ was isolated. A direct signal was received on the pole $N_1$ and a coupled signal on the pole $N_2$.

According to the invention a slow-wave type of line is used selected from those described above, on the one hand, and, on the other hand, as shown in FIG. 19, two input signals i.e. $V_1$ on pole $N_1$ and $V_2$ on pole $N_3$ are applied as explained above (via the single aerial A). The pole $N_4$ is the isolated pole, the pole $N_2$ is the output pole for the signal $V_2$ and the pole $N_3$ is the output pole for the signal $V_1$.

As in the thirteenth embodiment, and as illustrated by means of the FIGS. 18 and 19, a coupler of the amplifiers $\Delta_1$ and $\Delta_2$ is added for optimization of the results.

The technology used is the same as in the thirteenth embodiment and the results are identical except for that which relates to the passband which is less wide.

However, in order to widen the passband, the branched coupler may have several branches arranged in parallel to the branches 201 and 202.

The area covered by the arrangement according to the fourteenth embodiment is furthermore slightly larger than that covered by the arrangement according to the thirteenth embodiment, but this arrangement is nevertheless perfectly integrable.

Fifteenth Embodiment

In an exemplary method of use of the circuits according to the thirteenth and fourteenth embodiments, for realising a microwave head of a radar transceiver module, as represented in FIG. 21, one has a generator 58 called local oscillator OL for signal $V_1$ having the frequency $F_1$, whose signal is applied to the amplifier $\Delta_1$ which may be formed by two amplifiers having an average power $\Delta'_1$, $\Delta''_1$. Subsequently, this signal is applied to the pole $N_1$ of the coupler 50. The pole $N_3$ is connected to the aerial A, the pole $N_4$ is connected to ground through the impedance $Z_c$, for example, of 50 Ω, the pole $N_2$ is connected to the input of the amplifier $\Delta_2$ which may be formed by two amplifiers which have a low-noise level $\Delta'_2$, $\Delta''_2$. The output signal of the amplifier $\Delta_2$ is applied to a mixer 59 which receives also the signal at the frequency $F_1$ coming from the local oscillator 58 and whose output produces the intermediate frequency $IF=|F_2-F_1|$.

The applications of such a circuit are numerous:

Mobile communications

Doppler radar

Application to microwave radio links, automotive electronics (anti-collision radar, speed detection) etc. Particularly in the automotive industry one needs integrated circuits for reasons of manufacturing costs and also circuits operating in the 60 to 80 GHz band because otherwise these circuits would cause spectral problems.

The circuit according to the invention is integrable and at the same time perfectly suitable to operate at these high frequencies. It thus certainly satisfies these conditions, however strict they are.

I claim:

1. A slow-wave transmission line of a microstrip type comprising.

a first conductive layer being a ground plane, a second conductive layer being at least one second conductive strip having specific transverse and longitudinal dimensions, and a third non-conductive layer disposed between said first and second conductive layers, wherein the transmission line is disposed in a periodic structure of said second conductive strip in a longitudinal direction, said periodic structure having a period of length L, each period being one bridge structure and one column structure, wherein each said bridge structure consists of a first section of said second conductive strip having a length $L_1 < L$, said first section of said second conductive strip having a portion disposed on a first part of said third non-conductive layer, said third non-conductive layer being dielectric, wherein said first part of said third non-conductive layer beneath said bridge structure is air and has a relative permittivity $\epsilon_{r1}$ with a value of 1, and wherein each column structure forms a capacitance.

2. A transmission line according to claim 1, wherein each said capacitance is a MIM (Metal Insulator Metal) type, said capacitance being defined by a stack of a second section of said second conductive strip having a length $L_2$ on a second part of said third dielectric layer disposed on said first conductive layer, said lengths $L_1$ and $L_2$ equal said period of length L.

3. A transmission line according to claim 2, wherein said second part of said third dielectric layer has a thickness $e_2$ less than a thickness $e_1$ of said first part of said third dielectric layer below each said bridge structure, said second part of said third dielectric layer forming a continuous dielectric layer on said first conductive layer, said continuous dielectric layer having dimensions that avoid a short circuit between said first conductive layer and said second conductive strip.

4. A transmission line according to claim 2, wherein said second part of said third dielectric layer is confined to regions having said MIM structure, said second part of said third dielectric layer having dimensions to avoid short-circuiting between said first conductive layer and said second conductive strip.

5. A transmission line according to claim 4, wherein said second part of said third dielectric layer is one of silicon dioxide ($SiO_2$) or silicon nitride ($Si_3N_4$).

6. A transmission line according to claim 5, wherein said first conductive layer has a first transverse dimension $W_1$ and said second conductive strip has a second transverse dimension $W_2$, said second part of said third dielectric layer has a relative permittivity of $\epsilon_{r2}$ in said MIM structures wherein $\epsilon_{r2}$ has a value of 6 or 7 (silicon dioxide or silicon nitride), wherein a thickness $e_1$ of said first dielectric part ranges from about 1.5 μm to 2.5 μm and a thickness $e_2$ of said second dielectric part is $e_1/10$, wherein said length $L_l$ has a value of about 100 μm and said length $L_2$ has a value of about $L_1/10$, wherein said width dimension of $W_1$ of said first conductive layer has a value of about 100 μm and a width of said second conductive strip has a value of about 20 μm, and wherein a recess is formed in said first conductive layer below said bridge structure with a length $L_3$ equivalent to $L_1$, as required.

7. A transmission line according to claim 4, wherein a thickness $e_1$ of said first part of said third dielectric layer is equal to a thickness $e_2$ of said second part of said third dielectric layer.

8. A transmission line according to claim 2, wherein said period of length L is constant to obtain a constant slow-down factor $\lambda_0/\lambda_G$, where $\lambda_0$ is the wavelength in free space and $\lambda_G$ is the wavelength propagating in the transmission line, said constant slow-down factor being obtained at the same time as a non-constant phase shift $\beta$ as a function of frequency in said line.

9. A transmission line according to claim 2, wherein said period of length L is increasing to obtain a variable slow-down factor $\lambda_0/N_G$, where $\lambda_0$ is the wavelength in free space and $\lambda_G$ is the wavelength propagating in the transmission line, said variable slow-down factor being obtained at the same time as a constant phase shift $\beta'$ as a function of frequency in said line.

10. A transmission line according to claim 9, wherein said period of length L increases geometrically.

11. A transmission line according to claim 2, wherein said transmission line is disposed on a surface of a support together with an integrated circuit, and wherein said transmission line constitutes at least one element of said integrated circuit.

12. A transmission line according to claim 2, wherein said capacitance has alternate values along the transmission line.

13. A transmission line according to claim 1, wherein said capacitance of each column structure is provided by one of capacitance of a diode or capacitance of a field effect transistor.

14. A transmission line according to claim 13, wherein a transistor is disposed in a region of said column structures on a support structure, wherein said first conductive layer is extended in said region to include transverse and longitudinal dimensions characteristic of one of a Schottky contact or a gate of said field effect transistor, wherein said gate is disposed parallel to said longitudinal direction and is disposed on a surface of said support structure at an active zone, said gate being disposed between two ohmic spots respectively being a source and a drain having no electrical contact with said first conductive layer, and wherein said second conductive layer is at least two of said second conductive strips, each being disposed longitudinally at either of two sides of said active zone, said two second conductive strips establishing electrical contact with said source and drain while avoiding short-circuiting between said first conductive layer and said two second conductive strips in areas where said first conductive layer and said two second conductive strips are superimposed at a small separation.

15. A transmission line according to claim 14, wherein said two second conductive strips and said first conductive layer are each connected to different continuous potentials, said potentials permitting operation of said transistor in a zone resulting in a predetermined gate-source capacitance for operation of slow waves through the transmission line.

16. A transmission line according to claim 13, wherein said period of length L is constant to obtain a constant slow-down factor $\lambda_0/\lambda_G$, where $\lambda_0$ is the wavelength in free space and $\lambda_G$ is the wavelength propagating in the transmission line, said constant slow-down factor being obtained at the same time as a non-constant phase shift $\beta$ as a function of frequency in said line.

17. A transmission line according to claim 13, wherein said period of length L is increasing to obtain a variable slow-down factor $_{80}\ o/\lambda_G$, where $\lambda_0$ is the wavelength in free space and $\lambda_G$ is the wavelength propagating in the transmission line, said variable slow-down factor being obtained at the same time as a constant phase shift $\beta'$ as a function of frequency in said line.

18. A transmission line according to claim 17, wherein said period of length L increases geometrically.

19. A transmission line according to claim 13, wherein said transmission line is disposed on a surface of a support together with an integrated circuit, and wherein said transmission line constitutes at least one element of said integrated circuit.

20. A transmission line according to claim 13, wherein said capacitance has alternate values along the transmission line.

21. A transmission line according to claim 1, wherein said transmission line is disposed on a surface of a support together with an integrated circuit, and wherein said transmission line constitutes at least one element of said integrated circuit.

22. A transmission line according to claim 21, wherein said integrated circuit further comprises a coplanar transmission line having a further conductive strip disposed on the surface of said support between two ground transmission lines, wherein said further conductive strip is continuously connected to said at least one second conductive strip of the slow-wave transmission line, wherein said two ground transmission lines are connected to said first conductive layer of said slow-wave transmission line while forming a single layer, and wherein a portion of an electrically insulating layer is disposed between respective second conductive strips of said slow-wave transmission line and said coplanar transmission line in the connection zone to avoid a short-circuit.

23. A transmission line according to claim 21, wherein said period of length L is constant to obtain a constant slow-down factor $\lambda_0,/\lambda_G$, where $\lambda_0$ is the wavelength in free space and $\lambda_G$ is the wavelength propagating in the transmission line, said constant slow-down factor being obtained at the same time as a non-constant phase shift $\beta$ as a function of frequency in said line.

24. A transmission line according to claim 21, wherein said period of length L is increasing to obtain a variable slow-down factor $\lambda_0/_{80\ G}$, where $\lambda_O$ is the wavelength in free space and $\lambda_G$ is the wavelength propagating in the transmission line, said variable slow-down factor being obtained at the same time as a constant phase shift $\beta'$ as a function of frequency in said line.

25. A transmission line according to claim 24, wherein said period of length L increases geometrically.

26. A transmission line according to claim 21, wherein said capacitance has alternate values along the transmission line.

27. A transmission line according to claim 21, wherein said integrated circuit comprises a coupler, and wherein said transmission line constitutes at least one element of said coupler.

28. A transmission line according to claim 27, wherein said coupler is of a de Lange type having an odd number of interdigitized said slow-wave transmission lines.

29. A transmission line according to claim 27, wherein said coupler is of a branched type, each branch including one of said slow-wave transmission lines.

30. A transmission line according to claim 27, wherein said integrated circuit further comprises for realizing a transceiver arrangement, frequency duplexer means for transmitting a first signal and for receiving a second signal on a single pole, wherein said frequency duplexer means is said directional coupler having two first poles electromagnetically coupled to two second poles, said directional coupler being one of a de Lange coupler or a branched type coupler, wherein one of said two first poles provides an input to said directional coupler for a first signal from a first amplifier and another of said two first poles provides an output from said coupler for a second signal, said second signal being propagated to an input of a second amplifier, and wherein one of said two second poles provides an output for said first signal and an input for said second signal and another of said two second poles is isolated.

31. A transmission line according to claim 30, wherein said one of said two second poles is connected to a single transceiver aerial for said first and second signals.

32. A transmission line according to claim 31, wherein said circuit is further connected to a radar.

33. A transmission line according to claim 1, wherein said first conductive layer has at least one recess below each bridge structure.

34. A transmission line according to claim 33, wherein the number of recesses in said first conductive layer below each bridge structure exceeds 1.

35. A transmission line according to claim 33, wherein said period of length L is constant to obtain a constant slow-down factor $\lambda_0/\lambda_G$, where $\lambda_0$ is the wavelength in free space and $\lambda_G$ is the wavelength propagating in the transmission line, said constant slow-down factor being obtained at the same time as a non-constant phase shift $\beta$ as a function of frequency in said line.

36. A transmission line according to claim 33, wherein said period of length L is increasing to obtain a variable slow-down factor $\lambda_0/\lambda_G$, where $\lambda_0$ is the wavelength in free space and $\lambda_G$ is the wavelength propagating in the transmission line, said variable slow-down factor being obtained at the same time as a constant phase shift $\beta'$ as a function of frequency in said line.

37. A transmission line according to claim 36, wherein said period of length L increases geometrically.

38. A transmission line according to claim 33, wherein said transmission line is disposed on a surface of a support together with an integrated circuit, and wherein said transmission line constitutes at least one element of said integrated circuit.

39. A transmission line according to claim 33, wherein said capacitance has alternate values along the transmission line.

* * * * *